US008896492B2

(12) United States Patent
Koide et al.

(10) Patent No.: US 8,896,492 B2
(45) Date of Patent: Nov. 25, 2014

(54) DEFORMED FOLDED DIPOLE ANTENNA, METHOD OF CONTROLLING IMPEDANCE OF THE SAME, AND ANTENNA DEVICE INCLUDING THE SAME

(75) Inventors: Shiro Koide, Kariya (JP); Katsuhiro Ohara, Nagoya (JP); Seishin Mikami, Toyota (JP); Masaaki Hisada, Obu (JP); Ichiro Shigetomi, Nagoya (JP)

(73) Assignee: Denso Corporation, Kariya (JP)

( * ) Notice: Subject to any disclaimer, the term of this patent is extended or adjusted under 35 U.S.C. 154(b) by 1051 days.

(21) Appl. No.: 12/927,308

(22) Filed: Nov. 10, 2010

(65) Prior Publication Data

US 2011/0122038 A1 May 26, 2011

(30) Foreign Application Priority Data

Nov. 20, 2009 (JP) ..... 2009-265491
Sep. 24, 2010 (JP) ..... 2010-214051

(51) Int. Cl.
*H01Q 9/26* (2006.01)
*H01Q 9/04* (2006.01)
*H01Q 21/28* (2006.01)

(52) U.S. Cl.
CPC ..... *H01Q 9/26* (2013.01); *H01Q 9/0407* (2013.01); *H01Q 21/28* (2013.01)
USPC ..... 343/803

(58) Field of Classification Search
CPC ..... H01Q 9/26
USPC ..... 343/803
See application file for complete search history.

(56) References Cited

U.S. PATENT DOCUMENTS

| | | | | |
|---|---|---|---|---|
| 4,443,805 | A * | 4/1984 | Havot | 343/803 |
| 7,183,984 | B2 * | 2/2007 | Jarmuszewski et al. | 343/702 |
| 2002/0058483 | A1 * | 5/2002 | Shinichi et al. | 455/90 |
| 2007/0115200 | A1 | 5/2007 | Ishimiya | |
| 2008/0316135 | A1 * | 12/2008 | Hilgers | 343/795 |
| 2010/0066628 | A1 | 3/2010 | Ishimiya | |

FOREIGN PATENT DOCUMENTS

| | | |
|---|---|---|
| JP | 7-283651 | 10/1995 |
| JP | 9-505696 | 6/1997 |
| JP | 2002-152353 | 5/2002 |
| JP | 2004-228917 | 8/2004 |

(Continued)

OTHER PUBLICATIONS

Office action dated Nov. 15, 2011 in corresponding Japanese Application No. 2010-214051.

*Primary Examiner* — Dameon Levi
*Assistant Examiner* — Graham Smith
(74) *Attorney, Agent, or Firm* — Harness, Dickey & Pierce, PLC

(57) ABSTRACT

In a U-shaped deformed folded dipole antenna, a first parallel section having a feeding point includes first and second L-shape sections, and a second parallel section without a feeding point includes first and second opposing side portions and a connecting side portion coupling ends of the first and second opposing side portions. Portions of the first and second L-shape sections arranged in parallel with the first and second opposing side portions have a width W1. Portions of the first and second L-shape sections arranged in parallel with the connecting side portion have a width W2. The first and second opposing side portions have a width W3. The connecting side portion has a width W4. An impedance of the deformed folded dipole antenna is controlled by setting the width W2 to be larger than the widths W1, W3, and W4.

17 Claims, 10 Drawing Sheets

(56) References Cited

FOREIGN PATENT DOCUMENTS

| | | |
|---|---|---|
| JP | 2004-228918 | 8/2004 |
| JP | 2005-184570 | 7/2005 |
| JP | 2005-260566 | 9/2005 |
| JP | 2005-260567 | 9/2005 |
| JP | 2006-222657 | 8/2006 |
| JP | 2007-142799 | 6/2007 |
| WO | WO 95/06962 | 3/1995 |

* cited by examiner

W1=W2=W3=W4=1mm

W1=W2=1mm, W3=W4=0. 75mm

W1=W2=0. 75mm, W3=W4=1mm

W1=0. 75mm, W3=1mm
W2=1mm, W4=3mm

W1=0. 75mm, W3=1mm
W2=W4=3mm

W1=0. 75mm, W3=1mm
W2=3mm, W4=1mm

DEFORMED FOLDED DIPOLE ANTENNA, METHOD OF CONTROLLING IMPEDANCE OF THE SAME, AND ANTENNA DEVICE INCLUDING THE SAME

CROSS REFERENCE TO RELATED APPLICATIONS

The present application is based on and claims priority to Japanese Patent Applications No. 2009-265491 filed on Nov. 20, 2009, and No. 2010-214051 filed on Sep. 24, 2010, the contents of which are incorporated in their entirety herein by reference.

BACKGROUND OF THE INVENTION

1. Field of the Invention

The present invention relates to a deformed folded dipole antenna in which two parallel sections coupled through short sections are deformed into U-shapes opposed to each other. The present invention also relates to a method of controlling an impedance of a deformed folded dipole antenna and an antenna device including a deformed folded dipole antenna.

2. Description of the Related Art

As an example of a folded dipole antenna, JP-A-2005-260567 discloses a deformed folded dipole antenna.

The deformed folded dipole antenna includes a pair of parallel sections (side portions 9, 12 and side portions 10, 13 in FIG. 1 of JP-A-2005-260567) arranged in parallel with each other and short sections (folded structure 11, 14) respectively coupling ends of the pair of parallel sections. One of the parallel sections (side portions 9, 12) has a feeding point at a middle point of an electric length in a longitudinal direction.

The other parallel section (side portions 10, 13) without a feeding point has a U-shape including a pair of opposing side portions opposed to each other and a connecting side portion (a portion between the folded structures 16, 18) connecting ends of the opposing side portions.

The parallel section (side portions 9, 12) having the feeding point includes two L-shape sections. One (side portion 9) of the L-shape sections is arranged in parallel with a part of the connecting side portion and one of the opposing side portions (side portion 10). The other (side portion 12) of the L-shape sections is arranged in parallel with a part of the connecting side portion and the other of the opposing side portions (side portion 13).

In the two L-shape sections (side portions 9, 12), portions (portions between the folded structures 15, 17) opposed to the connecting side portions (portions between the folded structures 16, 18) are opposed to each other at a predetermined distance therebetween and are arranged in the same straight line with each other. Accordingly, the two L-shape sections form a cut U-shape. The feeding point is provided at end portions of the L-shape sections opposed to the connecting side portion.

Thus, in the deformed folded dipole antenna, the two parallel sections opposed to each other are coupled through the short sections, one of the parallel sections has the U-shape, and the other of the parallel sections has the cut U-shape.

When a width of each parallel section is uniform throughout a longitudinal direction, an impedance of a folded dipole antenna can be controlled by changing a ratio of a width of a parallel section having a feeding point with respect to a width of a parallel section without a feeding point as described, for example, in JP-A-2004-228917.

When the conventional impedance control method is applied to the deformed folded dipole antenna having the U-shape, a width of the cut U-shape of the parallel section having the feeding point are set to be smaller than a width of the U-shape of the parallel section without a feeding point throughout the longitudinal direction of each parallel section.

For example, when two parallel sections in a deformed folded dipole antenna have the same width, in order to increase an impedance of the deformed folded dipole antenna, the width of the parallel section including the feeding points is decreased throughout the longitudinal direction and the width of the parallel section without a feeding point is increased throughout the longitudinal direction. In the above-described case, an outside dimension of the deformed folded dipole antenna along a plane on which the U-shape are arranged depends on an outside dimension of the parallel section without a feeding point whose width is increased. Thus, the outside dimension of the deformed folded dipole antenna is increased both in a direction along the opposing side portions and a direction along the connecting side potion. Especially in a deformed folded dipole antenna in which parallel sections have U-shapes, because two opposing side portions are arranged in parallel with each other in a direction perpendicular to a connecting side portion, an outside dimension in a direction along the connecting side portion is increased by an increased amount of the widths of the two opposing side portions.

In contrast, in order to decrease the impedance, the width of the parallel section including the feeding points is increased throughout the longitudinal direction compared with the width of the parallel section without a feeding point.

For example, when two U-shaped parallel sections in a deformed folded dipole antenna have the same width, in order to decrease an impedance of the deformed folded dipole antenna, the width of the parallel section including the feeding points is increased throughout the longitudinal direction and the width of the parallel section without a feeding point is decreased throughout the longitudinal direction. In the above-described case, an outside dimension of the deformed folded dipole antenna along a plane on which the U-shape is arranged depends on an outside dimension of the parallel section having the feeding points whose width is increased. Thus, the outside dimension of the antenna is increased both in a direction along the opposing side portions and a direction along the connecting side portion. Especially in a folded dipole antenna in which parallel sections have U-shapes, because two opposing side portions are arranged in parallel with each other in a direction perpendicular to a connecting side portion, an outside dimension in a direction along the connecting side portion is increased by an increased amount of the widths of both of the opposing side portions.

In this way, when an impedance of a deformed folded dipole antenna having a U-shape is controlled so as to ensure an impedance matching with an external device such a coaxial cable and a parallel feeder line, widths of two opposing end portions in one of parallel sections are larger than before controlling impedance, and thereby the outside dimension of the deformed folded dipole antenna along the connecting side portion may be increased.

An increase of the outside dimension may also be restricted by fixing the width of one parallel section and decreasing a width of the other parallel section. However, there is a manufacturing limitation in decreasing the width. Especially, in a small antenna originally having a small width, a control range of impedance is small.

SUMMARY OF THE INVENTION

In view of the foregoing problems, it is an object of the present invention to provide a deformed folded dipole antenna having a U-shape. Another object of the present invention is to provide a method of controlling an impedance of a deformed folded dipole antenna. Another object of the present invention is to provide an antenna device including a deformed folded dipole antenna.

According to first to third aspects of the present invention, methods of controlling an impedance of a deformed folded dipole antenna are provided. The deformed folded dipole antenna includes a first parallel section, a second parallel section, and two short sections. The first parallel section and the second parallel section are made of a conductive material and are arranged in parallel with each other along a plane. The short sections are made of a conductive material. Each of the short sections is shorter than the first parallel section and the second parallel section. Each of the short sections couples an end of the first parallel section with a corresponding end of the second parallel section. The second parallel section has a U-shape including a first opposing side portion, a second opposing side portion, and a connecting side portion. The first opposing side portion and the second opposing side portion are opposed to each other and the connecting side portion couples an end of the first opposing side portion with an end of the second opposing side portion. The first parallel section has a cut U-shape including a first L-shape section and a second L-shape section. The first L-shape section includes a portion arranged in parallel with the first opposing side portion and a portion arranged in parallel with a part of the connecting side portion. The second L-shape section includes a portion arranged in parallel with the second opposing side portion and a portion arranged in parallel with another part of the connecting side portion. The first L-shape section has a feeding point at an end of the portion arranged in parallel with the connecting side portion. The second L-shape section has a feeing point at an end of the portion arranged in parallel with the connecting side portion. The portion of the first L-shape section arranged in parallel with the connecting side portion is arranged in a same straight line with the portion of the second L-shape section arranged in parallel with the connecting side portion. The end of the first L-shape section is opposed to the end of the second L-shape section at a distance. The portion of the first L-shape section arranged in parallel with the first opposing side portion and the portion of the second L-shape section arranged in parallel with the second opposing side portion have a width W1 in a direction along the plane. The portion of the first L-shape section arranged in parallel with the connecting side portion and the portion of the second L-shape section arranged in parallel with the connecting side portion have a width W2 in the direction along the plane. The first opposing side portion and the second opposing side portion have a width W3 in the direction along the plane. The connecting side portion has a width W4 in the direction along the plane.

The method of controlling the impedance of the deformed folded dipole antenna according to the first aspect includes setting the width W2 to be larger than the widths W1, W3, and W4. In the present case, the impedance of the deformed folded dipole antenna can be increased compared with a case where the width W2 is equal to the width W4 and a case where the width W2 is smaller than the width W4.

The method of controlling the impedance of the deformed folded dipole antenna according to the second aspect includes setting the width W4 to be larger than the widths W1-W3. In the present case, the impedance of the deformed folded dipole antenna can be decreased compared with a case where the width W4 is equal to the width W2 and a case where the width W4 is smaller than the width W2.

The method of controlling the impedance of the deformed folded dipole antenna according to the third aspect includes controlling a ratio of the width W2 with respect to the width W4 in a state where the width W1 and the width W3 are fixed. The impedance can be increased by increasing the ratio W2/W4, and the impedance can be decreased by decreasing the ratio W2/W4. Because the width W1 and the width W3 are fixed, an increase of a dimension in a direction along the connecting side portion can be effectively restricted.

According to a fourth aspect of the present invention, a deformed folded dipole antenna includes a first parallel section, a second parallel section, and two short sections. The first parallel section and the second parallel section are made of a conductive material and are arranged in parallel with each other along a plane. The short sections are made of a conductive material. Each of the short sections is shorter than the first parallel section and the second parallel section. Each of the short sections couples an end of the first parallel section with a corresponding end of the second parallel section. The second parallel section has a U-shape including a first opposing side portion, a second opposing side portion, and a connecting side portion. The first opposing side portion and the second opposing side portion are opposed to each other and the connecting side portion couples an end of the first opposing side portion with an end of the second opposing side portion. The first parallel section has a cut U-shape including a first L-shape section and a second L-shape section. The first L-shape section includes a portion arranged in parallel with the first opposing side portion and a portion arranged in parallel with a part of the connecting side portion. The second L-shape section includes a portion arranged in parallel with the second opposing side portion and a portion arranged in parallel with another part of the connecting side portion. The first L-shape section has a feeding point at an end of the portion arranged in parallel with the connecting side portion. The second L-shape section has a feeing point at an end of the portion arranged in parallel with the connecting side portion. The portion of the first L-shape section arranged in parallel with the connecting side portion is arranged in a same straight line with the portion of the second L-shape section arranged in parallel with the connecting side portion. The end of the first L-shape section is opposed to the end of the second L-shape section at a distance. The portion of the first L-shape section arranged in parallel with the first opposing side portion and the portion of the second L-shape section arranged in parallel with the second opposing side portion have a width W1 in a direction along the plane. The portion of the first L-shape section arranged in parallel with the connecting side portion and the portion of the second L-shape section arranged in parallel with the connecting side portion have a width W2 in the direction along the plane. The first opposing side portion and the second opposing side portion have a width W3 in the direction along the plane. The connecting side portion has a width W4 in the direction along the plane. The width W2 is larger than the widths W1, W3, and W4.

In the deformed folded dipole antenna according to the fourth aspect, the impedance can be increased compared with a case where the width W2 is equal to the width W4 and a case where the width W2 is smaller than the width W4.

According to a fifth aspect of the present invention, an antenna device includes the deformed folded dipole antenna according to the fourth aspect, the connecting side portion is arranged in parallel with a vertical direction, and the first opposing side portion and the second opposing side portion are perpendicular to the vertical direction.

In the antenna device according to the fifth aspect, an antenna gain (vertically polarized wave gain) can be improved compared with a case where the connecting side portion and the portions of the first L-shape section and the second L-shape section arranged in parallel with the connecting side portion are perpendicular to the vertical direction. Furthermore, a directivity in a hemisphere face provided on an upper side of the deformed folded dipole antenna can be non-directional for a vertically polarized wave.

According to a sixth aspect of the present invention, a deformed folded dipole antenna includes a first parallel section, a second parallel section, and two short sections. The first parallel section and the second parallel section are made of a conductive material and are arranged in parallel with each other along a plane. The short sections are made of a conductive material. Each of the short sections is shorter than the first parallel section and the second parallel section. Each of the short sections couples an end of the first parallel section with a corresponding end of the second parallel section. The second parallel section has a U-shape including a first opposing side portion, a second opposing side portion, and a connecting side portion. The first opposing side portion and the second opposing side portion are opposed to each other and the connecting side portion couples an end of the first opposing side portion with an end of the second opposing side portion. The first parallel section has a cut U-shape including a first L-shape section and a second L-shape section. The first L-shape section includes a portion arranged in parallel with the first opposing side portion and a portion arranged in parallel with a part of the connecting side portion. The second L-shape section includes a portion arranged in parallel with the second opposing side portion and a portion arranged in parallel with another part of the connecting side portion. The first L-shape section has a feeding point at an end of the portion arranged in parallel with the connecting side portion. The second L-shape section has a feeing point at an end of the portion arranged in parallel with the connecting side portion. The portion of the first L-shape section arranged in parallel with the connecting side portion is arranged in a same straight line with the portion of the second L-shape section arranged in parallel with the connecting side portion. The end of the first L-shape section is opposed to the end of the second L-shape section at a distance. The portion of the first L-shape section arranged in parallel with the first opposing side portion and the portion of the second L-shape section arranged in parallel with the second opposing side portion have a width W1 in a direction along the plane. The portion of the first L-shape section arranged in parallel with the connecting side portion and the portion of the second L-shape section arranged in parallel with the connecting side portion have a width W2 in the direction along the plane. The first opposing side portion and the second opposing side portion have a width W3 in the direction along the plane. The connecting side portion has a width W4 in the direction along the plane. The width W4 is larger than the widths W1-W3.

In the deformed folded dipole antenna according to the sixth aspect, the impedance can be decreased compared with a case where the width W4 is equal to the width W2 and a case where the width W4 is smaller than the width W2.

According to a seventh aspect of the present invention, an antenna device includes the deformed folded dipole antenna according to the sixth aspect, the connecting side portion is arranged in parallel with a vertical direction, and the first opposing side portion and the second opposing side portion are perpendicular to the vertical direction.

In the antenna device according to the seventh aspect, an antenna gain (vertically polarized wave gain) can be improved compared with a case where the connecting side portion and the portions of the first L-shape section and the second L-shape section arranged in parallel with the connecting side portion are perpendicular to the vertical direction. Furthermore, a directivity in a hemisphere face provided on an upper side of the deformed folded dipole antenna can be non-directional for a vertically polarized wave.

BRIEF DESCRIPTION OF THE DRAWINGS

Additional objects and advantages of the present invention will be more readily apparent from the following detailed description of preferred embodiments when taken together with the accompanying drawings. In the drawings.

DETAILED DESCRIPTION OF THE PREFERRED EMBODIMENTS

A process that the inventors of the present application created the present invention will be described before describing preferred embodiments of the present invention.

Figure 1:
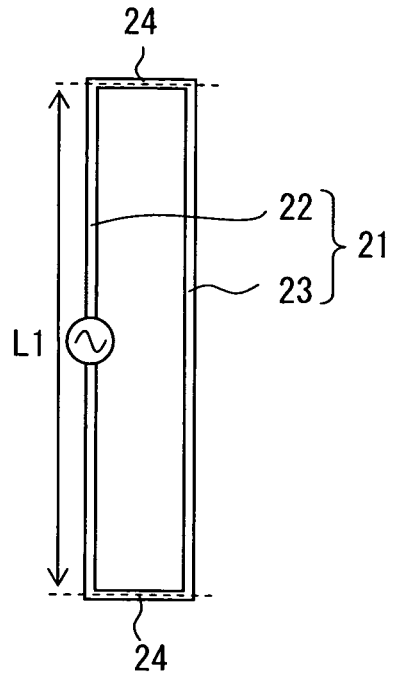
FIG. 1 is a diagram showing an example of a folded dipole antenna.

First of all, a conventional folded dipole antenna will be described with reference to FIG. 1. The folded dipole antenna includes two parallel sections 21 and two short sections 24. The parallel sections 21 are arranged in parallel each other, and each of the parallel sections 21 has an electric length L1 that is about a half of a wavelength. Each of the short sections 24 is sufficiently shorter than the parallel sections 21. Each of the short sections 24 electrically couples an end of one of the parallel sections 21 with an end of the other of the parallel sections 21. One of the parallel sections 21 is a first parallel section 22, and the other of the parallel sections 21 is a second parallel section 23. At a middle of the electric length of the first parallel section 22, a feeding point is provided. The first parallel section 22 has a structure similar to a half wavelength dipole antenna. The second parallel section 23 is arranged in parallel with the first parallel section 22 throughout the entire length of second parallel section 23. The two ends of the first parallel section 22 are coupled with two ends of the second parallel section 23 through the short sections 24, and thereby the folded dipole antenna is formed. An impedance R of the folded dipole antenna is about 293Ω, which is four times more than an impedance of a dipole antenna.

Figure 2:
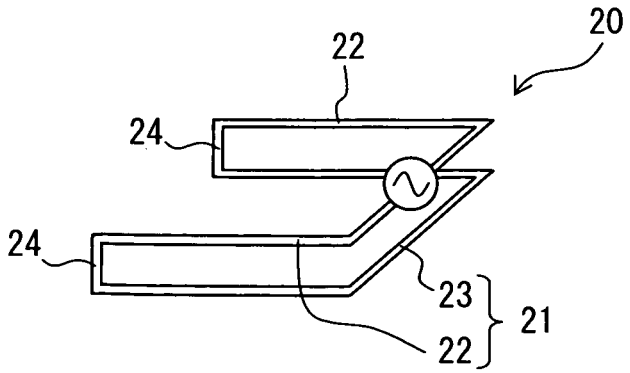
FIG. 2 is a diagram showing an example of a deformed folded dipole antenna.

In folded dipole antennas, the inventors studied a deformed folded dipole antenna 20 as shown in FIG. 2. In the deformed folded dipole antenna 20, the first parallel section 22 and the second parallel section 23 coupled through the short sections 24 are deformed into U-shapes opposed to each other. The first parallel section 22 has two L-shape portions on opposite sides of the feeding point. By deforming the first parallel section 22 and the second parallel section 23, impedance can be decreased compared with the impedance of the folded dipole antenna shown in FIG. 1.

The deformed folded dipole antenna 20 can be used for a band range (2.5 GHz) of a Vehicle Information and Communication System (VICS). In Japan, "VICS" is a registered trademark of a Vehicle Information and Communication System Center. In other words, the deformed folded dipole antenna 20 can be configured to receive road traffic information.

Figure 3A:
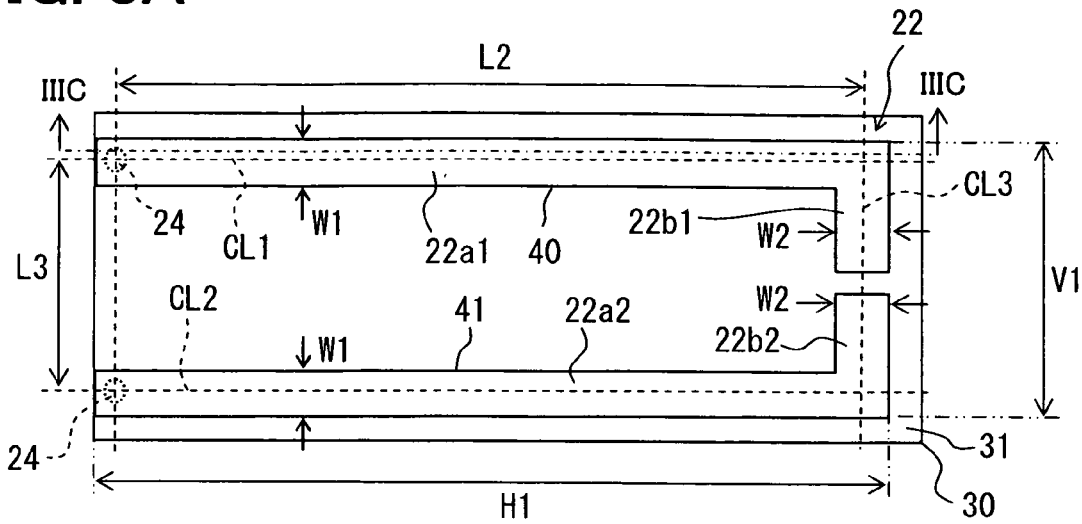
FIG. 3A is a top view of a deformed folded dipole antenna used in a study of impedance.
Figure 3B:
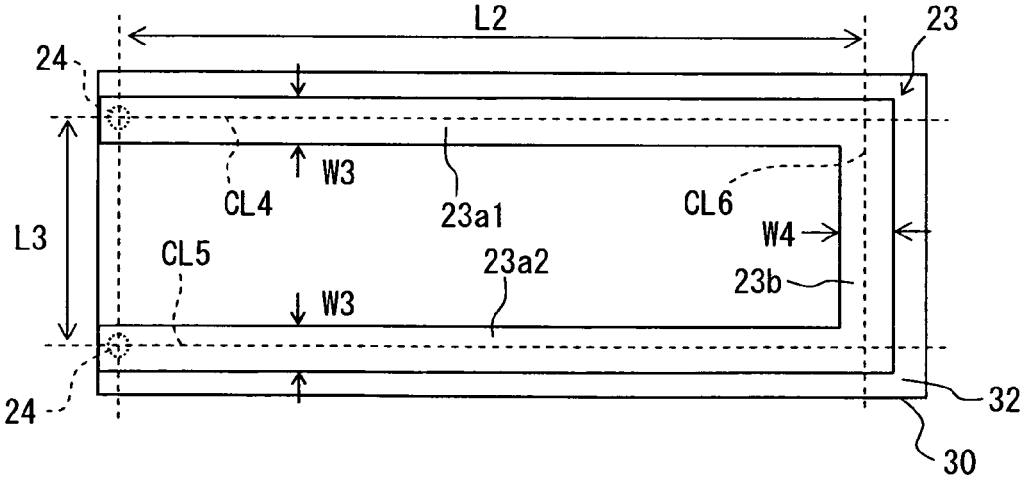
FIG. 3B is a bottom view of the deformed folded dipole antenna.
Figure 3C:
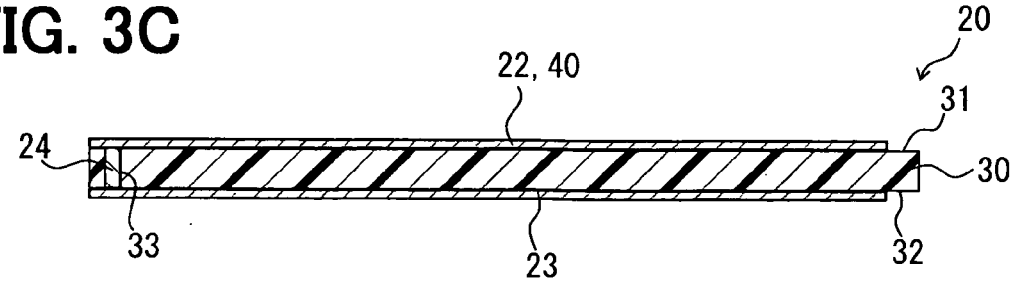
FIG. 3C is a cross-sectional view of the deformed folded dipole antenna taken along line IIIC-IIIC in FIG. 3A.

The deformed folded dipole antenna 20 can be formed as shown in FIG. 3A to FIG. 3C. A substrate 30 having a predetermined thickness and having a rectangular plane shape is prepared. On the whole area of a front surface 31 and a rear surface 32 of the substrate 30, a conductive film is formed. For example, the substrate 30 is a glass epoxy substrate (FR-4) having a thickness of 0.8 mm, and the conductive film is a copper film having a thickness of 18 μm.

The conductive films on the front surface 31 and the rear surface 32 are treated with patterning and the parallel sections 21 having U-shapes are formed. For example, the first parallel section 22 is formed on the front surface 31 and the second parallel section 23 is formed on the rear surface 32. Through holes 33 that penetrate the substrate 30 in a thickness direction of the substrate 30 are provided. By filling the through holes 33 with a conductive member, the short sections 24 coupling end portions of the feed parallel portion 22 with end portions of the second parallel sections 23 are formed. For example, each of the short sections 24 is formed by plating and has a diameter of 0.3 mm.

As shown in FIG. 3B, the second parallel section 23 has a U-shape including a pair of opposing side portions 23*a*1, 23*a*2 and a connecting side portion 23*b*. The opposing side portions 23*a*1 and 23*a*2 are opposed to each other and a connecting side portion 23*b* couples ends of the opposing side portions 23*a*1 and 23*a*2 on the same side.

A center line CL4 shown in FIG. 3B is a line that passes through a center of a width direction of the opposing side portion 23*a*1 and extends along the opposing side portion 23*a*1. A center line CL5 shown in FIG. 3B is a line that passes through a center of a width direction of the opposing side portion 23*a*2 and extends along the opposing side portion 23*a*2. A center line CL6 shown in FIG. 3B is a line that passes through a center of a width direction of the connecting side portion 23*b* and extends along the connecting side portion 23*b*. Each of the opposing side portions 23*a*1 and 23*a*2 has a width W3. The connecting side portion 23*b* has a width W4. The width W3 and the width W4 are widths in directions perpendicular to a flow direction of electric current.

As described above, both of the opposing side portions 23*a*1 and 23*a*2 have the width W3, and both of the opposing side portions 23*a*1 and 23*a*2 have the length (electric length) L2. As shown in FIG. 3B, the electric lengths of the opposing side portions 23*a*1 and 23*a*2 are lengths from points where the opposing side portions 23*a*1 and 23*a*2 are connected with the short sections 24 to points where the center lines CL4 and CL5 cross the center line CL6. In the study by the inventors, the length L2 is set to be 22.5 mm, and a length between the center lines CL4 and CL5 arranged in parallel with each other, that is, the length L3 of the connecting side portion 23*b* is set to be 7 mm. Thus, in the second parallel section 23 having the U-shape, the lengths L2 of the opposing side portions 23*a*1 and 23*a*2 are longer than the length L3 of the connecting side portion 23*b*. The values of the lengths L2 and L3 are fixed in the study.

The first parallel section 22 includes an L-shape section 40 and an L-shape section 41. The L-shape section 40 is arranged in parallel with a part of the connecting side portion 23*b* and the opposing side portion 23*a*1. The L-shape section 41 is arranged in parallel with a part of the connecting side portion 23*b* and the opposing side portion 23*a*2. The L-shape section 40 includes an opposing side portion 22*a*1 arranged in parallel with the opposing side portion 23*a*1 and a connecting side portion 22*b*1 arranged in parallel with a part of the connecting side portion 23*b*. The L-shape section 41 includes an opposing side portion 22*a*2 arranged in parallel with the opposing side portion 23*a*2 and a connecting side portion 22*b*2 arranged in parallel with a part of the connecting side portion 23*b*.

The first parallel section 22 receives electric power from an end of the connecting side portion 22*b*1 of the L-shape section 40 and an end of the connecting side portion 22*b*2 of the L-shape section 41. Thus, the L-shape section 40 has a feeding point at the end of the connecting side portion 22*b*1 arranged in parallel with the connecting side portion 23*b*, and the L-shape section 41 has a feeding point at the end of the connecting side portion 22*b*2 arranged in parallel with the connecting side portion 23*b*.

The connecting side portions 22*b*1 and 22*b*2 are arranged in the same straight line with each other in such a manner that the ends of the L-shape sections 40 and 41 functioning as the feeding points are opposed to each other at a distance. Accordingly, the first parallel section 22 has a cut U-shape. In the study, the distance between the ends of the L-shape sections 40 and 41 functioning as the feeding points is set to be 1 mm.

A center line CL1 shown in FIG. 3A is a line that passes through a center of a width direction of the opposing side portion 22*a*1 and extends along the opposing side portion 22*a*1. A center line CL2 shown in FIG. 3A is a line that passes through a center of a width direction of the opposing side portion 22*a*2 and extends along the opposing side portion 22*a*2. A center line CL3 shown in FIG. 3A is a line that passes through a center of a width direction of the connecting side portions 22*b*1 and 22*b*2 and extends along the connecting side portions 22*b*1 and 22*b*2. When viewed from a direction perpendicular to the front surface 31 and the rear surface 32 of the substrate 30, the center line CL1 overlaps the center line CL4 of the second parallel section 23, the center line CL2 overlaps the center line L6 of the second parallel section 23, and the center line CL3 overlaps the center line CL6 of the second parallel section 23. Thus, in the thickness direction of the substrate 30, the cut U-shape of the first parallel section 22 and the U-shape of the second parallel section 23 are opposed to each other and are parallel with each other.

Both of the opposing side portions 23*a*1 and 23*a*2 has a width W1, and both of the connecting side portions 23*b*1 and 23*b*2 arranged in the same straight line with each other have a width W2. The width W1 and the width W2 are widths in directions perpendicular to a flow direction of electric current.

Both of the opposing side portions 22*a*1 and 22*a*2 have the length (electric length) L2 that is same as the length of the opposing side portions 23*a*1 and 23*a*2. As shown in FIG. 3A, the electric lengths of the opposing side portions 22*a*1 and 22*a*2 are lengths from points where the opposing side portions 22*a*1 and 22*a*2 are connected with the short sections 24 to points where the center lines CL1 and CL2 cross the center line CL3. A distance between the center lines CL1 and CL2 arranged in parallel with each other is the length L3 that is same as the distance between the center lines CL4 and CL5 of the second parallel section 23. In the following description, the thickness direction of the substrate 30 is called, simply, "the thickness direction." A direction along planes (the front surface 31 and the rear surface 32) of the substrate 30, that is, planes on which the cut U-shape of the first parallel section 22 and the U-shape of the second parallel section 23 are arranged is called "plane direction". In the plane direction, a direction along the connecting side portions 22*b*1, 22*b*2, and 23*b* is called "V-direction," and a direction along the opposing side portions 22*a*1, 22*a*2, 23*a*1, 23*a*2 are called "H-direction."

The deformed folded dipole antenna 20 has an outside dimension V1 in the V-direction. The outside dimension V1 is at least one of an outside dimension of the first parallel section 22 in the V-direction and an outside dimension of the second parallel section 23 in the V-direction which is longer. In the example shown in FIG. 3A and FIG. 3B, the width W1 is the same as the width W3. Therefore, the outside dimension of the second parallel section 23 in the V direction is also V1.

The deformed folded dipole antenna 20 has an outside dimension H1 in the H-direction. The outside dimension H1 is at least one of an outside dimension of the first parallel section 22 in the H-direction and an outside dimension of the second parallel section 23 in the H-direction which is longer. In the example shown in FIG. 3A and FIG. 3B, the width W2 is the same as the width. W4. Therefore, the outside dimension of the second parallel section 23 in the H direction is also H1.

The inventors prepared various samples of the deformed folded dipole antennas 20 in which the widths W1-W4 are changed and measured an impedance R (Ω) of each antenna.

A conventional impedance control method will be described below. In the conventional impedance controlling method, the width W1 of the opposing side portions 22*a*1 and 22*a*2 is equal to the width W2 of the connecting side portions 22*b*1 and 22*b*2, and the width W3 of the opposing side portions 23*a*1 and 23*a*2 is equal to the width W4 of the connecting side portion 23*b*. Then, the impedance is controlled by controlling a ratio W1/W3, that is, a ratio of the width W1 (=W2) of the first parallel section 22 with respect to the width W3 (=W4) of the second parallel section 23.

Figure 4A:
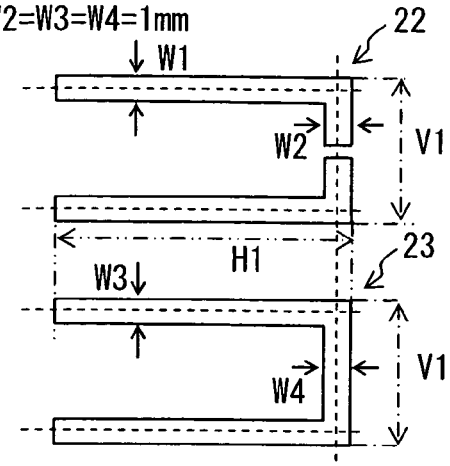
FIG. 4A is a diagram showing a first parallel section and a second parallel section in a case where widths W1-W4 are equal to each other.
Figure 4B:
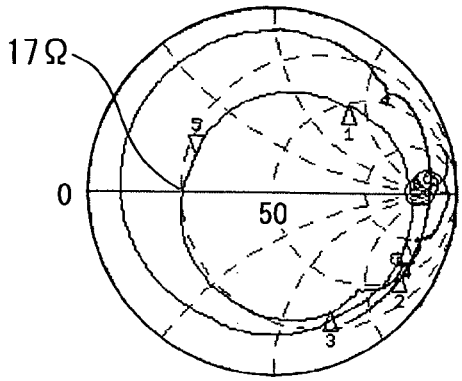
FIG. 4B is a Smith chart of a deformed folded dipole antenna including the first parallel section and the second parallel section shown in FIG. 4A.
Figure 5A:
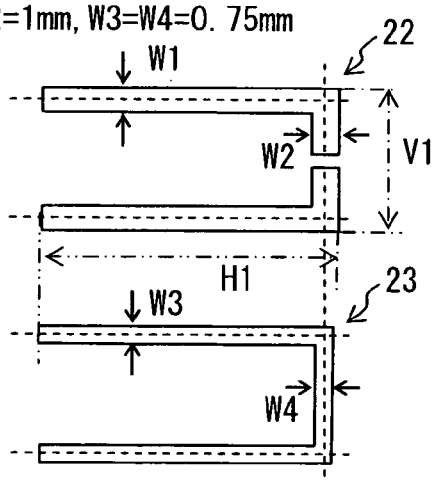
FIG. 5A is a diagram showing a first parallel section and a second parallel section in a case where widths W1 and W2 are larger than the widths W3 and W4.
Figure 5B:
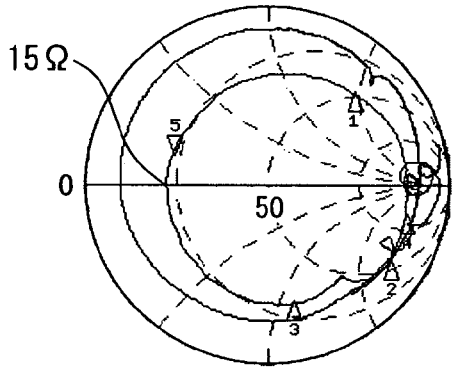
FIG. 5B is a Smith chart of a deformed folded dipole antenna including the first parallel section and the second parallel section shown in FIG. 5A.
Figure 6A:
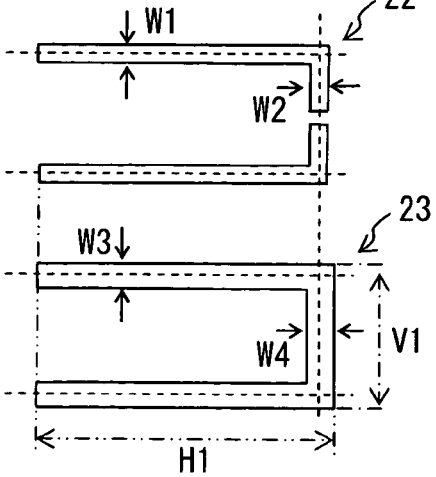
FIG. 6A is a diagram showing a first parallel section and a second parallel section in a case where widths W1 and W2 are smaller than the widths W3 and W4.
Figure 6B:
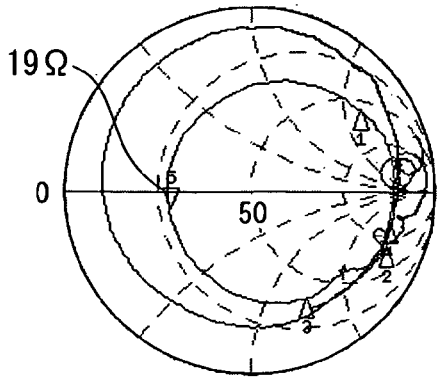
FIG. 6B is a Smith chart of a deformed folded dipole antenna including the first parallel section and the second parallel section shown in FIG. 6A.

In a case where all the widths W1-W4 of the deformed folded dipole antenna 20 are equal to each other (specifically, 1 mm) as shown in FIG. 4A, the impedance R is 17Ω as shown in FIG. 4B. In a case where the widths W1 and W2 of the first parallel section 22 are larger than the widths W3 and W4 of the second parallel section 23 (specifically, W1=W2=1 mm, W3=W4=0.75 mm) as shown in FIG. 5A, the impedance R is 15Ω as shown in FIG. 5B. In a case where the widths W1 and W2 of the first parallel section 22 are smaller than the widths W3 and W4 of the second parallel section 23 (specifically, W1=W2=0.75 mm, W3=W4=1 mm) as shown in FIG. 6A, the impedance R is 19Ω as shown in FIG. 6B.

In other words, in a case where the widths W1 and W2 of the first parallel section 22 having the feeding points are larger than the widths W3 and W4 of the second parallel section 23 without a feeding point, the impedance R of the deformed folded dipole antenna 20 decreases. In a case where the widths W1 and W2 of the first parallel section 22 having the feeding points are smaller than the widths W3 and W4 of the second parallel section 23 without a feeding point, the impedance R of the deformed folded dipole antenna 20 increases. This result is known.

In the example shown in FIG. 4A where all the widths W1-W4 are equal to each other, the outside dimensions of both of the first parallel section 22 and the second parallel section 23 become the outside dimensions V1 and H1 of the deformed folded dipole antenna 20. In the example shown in FIG. 5A where the widths W1 and W2 are larger than the widths W3 and W4, the outside dimensions of the first parallel section 22 having larger widths become the outside dimensions V1 and H1 of the deformed folded dipole antenna 20. In the example shown in FIG. 6A where the widths W1 and W2 are smaller than the widths W3 and W4, the outside dimensions of the second parallel section 23 having larger widths become the outside dimensions V1 and H1 of the deformed folded dipole antenna 20.

In this way, in the conventional impedance control method, the widths of the first parallel section 22 and the second parallel section 23 are changed throughout the longitudinal direction. Thus, when the impedance of the deformed folded dipole antenna 20 having the U-shape is controlled by the conventional method for ensuring an impedance matching with an external device such as a coaxial cable having an impedance of 50 Ω or 75Ω, the widths of two opposing side portions of one of the first parallel section 22 and the second parallel section 23 are larger than before controlling impedance, and the outside dimension of the deformed folded dipole antenna 20 in a direction along the connecting side portion (V-direction) may be increased.

For example, in a case where the impedance of the deformed folded dipole antenna 20 in which all the widths W1-W4 are equal to each other as shown in FIG. 4A is increased, the widths W1 and W2 of the first parallel section 22 are decreased and the widths W3 and W4 of the second parallel section 23 are increased. In this case, both in the V-direction and the H-direction, the outside dimensions V1 and H1 of the deformed folded dipole antenna 20 depend on the outside dimensions of the second parallel section 23 whose widths are increased. Thus, both in the V-direction and the H-direction, the outside dimensions of the deformed folded dipole antenna 20 become larger than before controlling impedance. Especially in the V-direction, because two opposing side portions 23*a*1 and 23*a*2 are arranged in parallel with each other, the outside dimension is increased by the increased amount of the widths of the two opposing side portions 23*a*1 and 23*a*2.

In contrast, in a case where the impedance of the deformed folded dipole antenna 20 in which all the widths W1-W4 are equal to each other as shown in FIG. 4A is decreased, the widths W1 and W2 of the first parallel section 22 are increased and the widths W3 and W4 of the second parallel section 23 are decreased. In this case, both in the V-direction and the H-direction, the outside dimensions V1 and H1 of the deformed folded dipole antenna 20 depend on the outside dimensions of the first parallel section 22 whose widths are increased. Thus, both in the V-direction and the H-direction, the outside dimensions of the deformed folded dipole antenna 20 become larger than before controlling impedance. Especially in the V-direction, because two opposing side portions 22*a*1 and 22*a*2 are arranged in parallel with each other, the outside dimension is increased by the increased amount of the widths of the two opposing side portions 22*a*1 and 22*a*2.

In this way, in the conventional impedance control method in which the width is changed throughout the longitudinal direction, the widths of the opposing side portions of one of the first parallel section 22 and the second parallel section 23 become larger than before controlling, and thereby the outside dimension in the V-direction is increased.

An increase of the outside dimension may also be restricted by fixing the width of one of the parallel sections 22 and 23 and decreasing the width of the other of the parallel sections 22 and 23. However, there is a manufacturing limitation in decreasing the width. Especially, in a small antenna originally having a small width, a control range of impedance is small.

Thus, the inventors made a study on whether the impedance can be controlled by changing only the widths W2 and W4 of the connecting side portions. The results of the study are shown in FIG. 7A to FIG. 9B. In the study, the width W1 of the opposing side portions 22*a*1 and 22*a*2 of the first parallel section 22 is fixed to 0.75 mm and the width W3 of the opposing side portions 23*a*1 and 23*a*2 of the second parallel section 23 is fixed to 1 mm. That is, the widths W1 and W3 of the opposing side portions are same as the example shown in FIG. 6A.

Figure 7A:
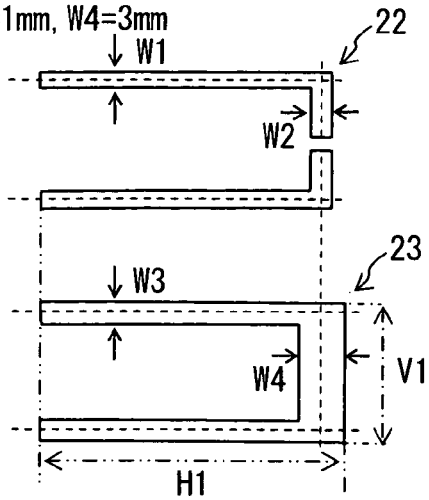
FIG. 7A is a diagram showing a first parallel section and a second parallel section in a case where the width W4 is larger the widths W1-W3.
Figure 7B:
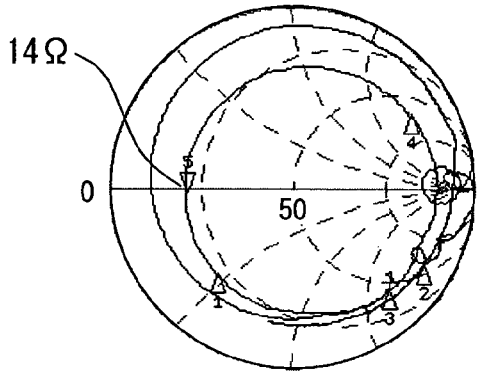
FIG. 7B is a Smith chart of a deformed folded dipole antenna including the first parallel section and the second parallel section shown in FIG. 7A.

In a case where the width W2 of the connecting side portions 22*b*1 and 22*b*2 of the first parallel section 22 is 1 mm and the width W4 of the connecting side portion 23*b* of the second parallel section 23 is 3 mm, that is, in a case where the width W2 is smaller than the width W4 as shown in FIG. 7A, the impedance R is 14 Ω as shown in FIG. 7B. The value of the impedance R of the example shown in FIG. 7A is less than the impedances R of the examples shown in FIG. 4A, FIG. 5A, and FIG. 6A. In the example shown in FIG. 7A, the width W1<the width W2=the width W3<the width W4. In this way, the inventors found that the impedance can be decreased by setting the width W2 of the first parallel section 22 to be smaller than the width W4 of the second parallel section 23.

Figure 8A:
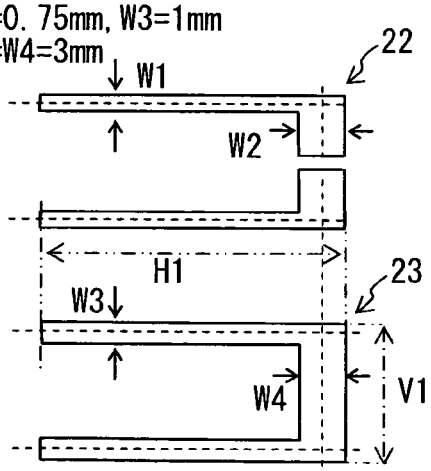
FIG. 8A is a diagram showing a first parallel section and a second parallel section in a case where the widths W2 and W4 are larger the widths W1 and W3.
Figure 8B:
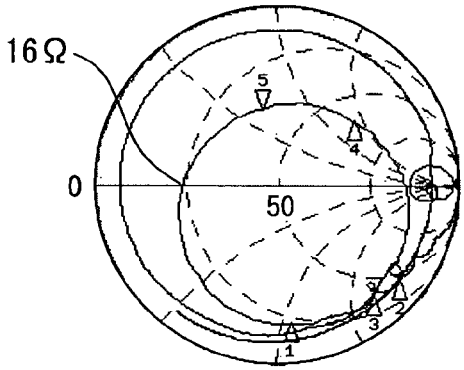
FIG. 8B is a Smith chart of a deformed folded dipole antenna including the first parallel section and the second parallel section shown in FIG. 8A.

In a case where the width W2 of the connecting side portions 22*b*1 and 22*b*2 of the first parallel section 22 is 3 mm and the width W4 of the connecting side portion 23*b* of the second parallel section 23 is 3 mm, that is, in a case where the width W2 is equal to the width W4 as shown in FIG. 8A, the impedance R is 16Ω as shown in FIG. 8B. Thus, the impedance R of the example shown in FIG. 8A becomes a value between the impedance R (17Ω) of the example shown in FIG. 4A and the impedance R (15Ω) of the example shown FIG. 5A. In the example shown in FIG. 8A, the width W1<the width W3<the width W2=the width W4.

Figure 9A:
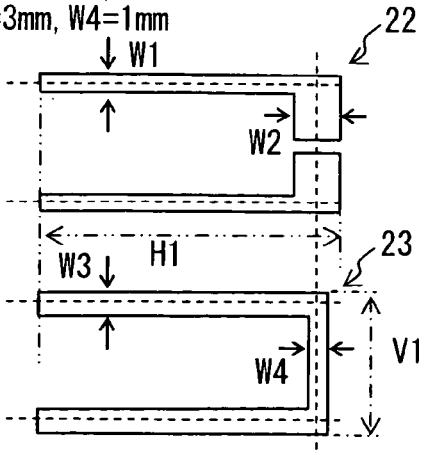
FIG. 9A is a diagram showing a first parallel section and a second parallel section in a case where the width W2 is larger the widths W1, W3, and W4.
Figure 9B:
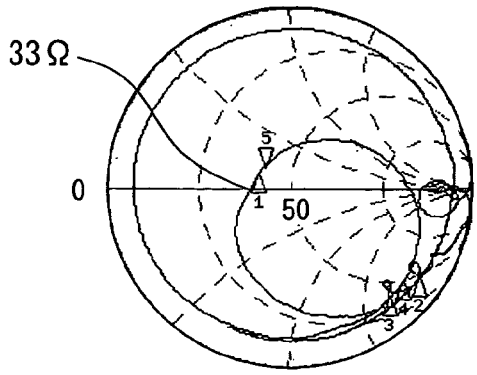
FIG. 9B is a Smith chart of a deformed folded dipole antenna including the first parallel section and the second parallel section shown in FIG. 9A.

In a case where the width W2 of the connecting side portions 22*b*1 and 22*b*2 of the first parallel section 22 is 3 mm and the width W4 of the connecting side portion 23*b* of the second parallel section 23 is 1 mm, that is, in a case where the width W2 is larger than the width W4 as shown in FIG. 9A, the impedance R is 33Ω as shown in FIG. 9B. Thus, the impedance R of the example shown in FIG. 9A is larger than the impedances R of the examples shown in FIGS. 4A, 5A, and 6A. In the example shown in FIG. 9A, the width W1<the width W3=the width W4<the width W2. In this way, the inventors found that the impedance can be increased by setting the width W2 of the first parallel section 22 to be larger than the width W4 of the second parallel section 23.

In addition, the inventors found that there is no difference in directivity of the examples shown in FIG. 4A to FIG. 9A. Thus, even when the impedance of the deformed folded dipole antenna 20 is controlled by changing the widths W2 and W4, the directivity of the deformed folded dipole antenna 20 is maintained.

From the above-described study, the inventors obtained the knowledge that the impedance of the deformed folded dipole antenna can be controlled as follows without changing the width W1 of the opposing side portions 22*a*1 and 22*a*2 of the first parallel section 22 and the width W3 of the opposing side portions 23*a*1 and 23*a*2 of the second parallel section 23.

(i) By setting the width W2 of the connecting side portions 22*b*1 and 22*b*2 of the first parallel section 22 to be larger than the width W4 of the connecting side portion 23*b* of the second parallel section 23 (W2>W4), the impedance of the deformed folded dipole antenna 20 can be increased compared with a case where the width W2 is equal to the width W4 (W2=W4) and a case where the width W2 is smaller than the width W4 (W2<W4).

(ii) By setting the width W4 of the connecting side portion 23*b* of the second parallel section 23 to be larger than the width W2 of the connecting side portions 22*b*1 and 22*b*2 of the first parallel section 22 (W4>W2), the impedance of the deformed folded dipole antenna 20 can be decreased compared with a case where the width W4 is equal to the width W2 (W4=W2) and a case where the width. W4 is smaller than the width W2 (W4<W2).

(iii) By setting the width W2 of the connecting side portions 22*b*1 and 22*b*2 of the first parallel section 22 to be larger than the widths W1, W3, and W4, the impedance of the deformed folded dipole antenna 20 can be increased.

(iv) By setting the width W4 of the connecting side portion 23*b* of the second parallel section 23 to be larger than the widths W1-W3, the impedance of the deformed folded dipole antenna 20 can be decreased.

The present invention is based on the above-described knowledge (i)-(iv).

First Embodiment

Figure 10A:
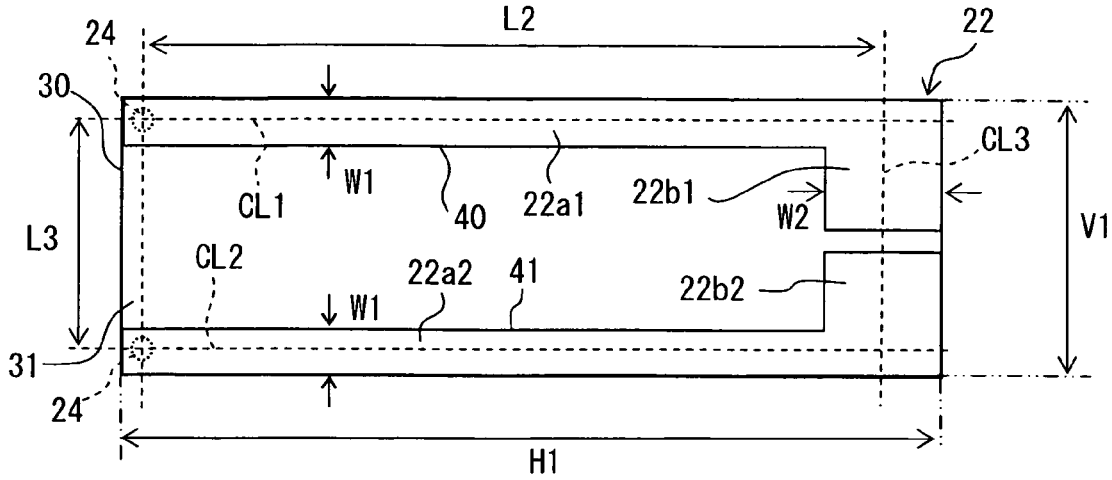
FIG. 10A is a plan view showing a first parallel section in a deformed folded dipole antenna according to a first embodiment of the present invention.
Figure 10B:
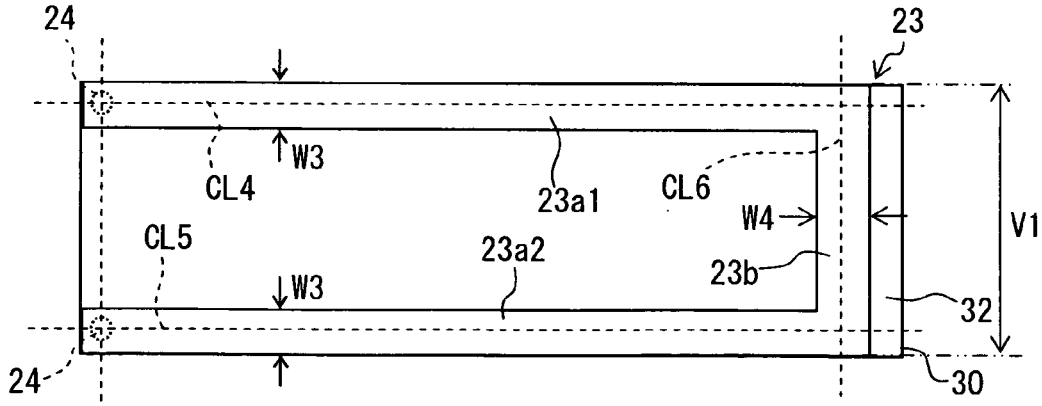
FIG. 10B is a plan view showing a second parallel section in the deformed folded dipole antenna according to the first embodiment.

A deformed folded dipole antenna 20 according to a first embodiment of the present invention will be described with reference to FIG. 10A and FIG. 10B.

A configuration of a deformed folded dipole antenna 20 according to the present embodiment is similar to the configuration of the deformed folded dipole antenna 20 shown in FIG. 3. The deformed folded dipole antenna 20 according to the present embodiment can be used for receiving road traffic information. The deformed folded dipole antenna 20 includes the first parallel section 22, the second parallel section 23 and the two short sections 24. The first parallel section 22 and the second parallel section 23 are made of a conductive material and arranged in parallel with each other along a plane. The short sections 24 are made of a conductive material. Each of the short sections 24 is shorter than the first parallel section 22 and the second parallel section 23. Each of the short section 24 couples an end of the first parallel section 22 with a corresponding end of the second parallel section 23. In a direction along the plane, the width W1 of the opposing side portions 22*a*1 and 22*a*2 of the first parallel section 22, the width W3 of the opposing side portions 23*a*1 and 23*a*2 of the second parallel section 23, and the width W4 of the connecting side portion 23*b* of the second parallel section 23 are equal to each other, and the width W2 of the connecting side portions 22*b*1 and 22*b*2 of the first parallel section 22 is larger than the widths W1, W3, and W4.

In the direction along the plane, outside dimensions of the substrate 30 correspond to the outside dimensions V1 and H1 of the deformed folded dipole antenna 20 so that the outside dimensions of the deformed folded dipole antenna 20 including the substrate 30 can be small.

The width W2 of the connecting side portions 22*b*1 and 22*b*2 of the first parallel section 22 is larger than the width W4 of the connecting side portion 23*b* of the second parallel section 23 (W2>W4). Thus, the impedance of the folded dipole antenna 20 can be larger than a case where the width W2 is equal to the width W4 (W2=W4) and a case where the width W2 is smaller than the width W4 (W2<W4).

The width W2 of the connecting side portions 22*b*1 and 22*b*2 of the first parallel section 22 is larger than the width W1 of the opposing side portions 22*a*1 and 22*a*2 of the first parallel section 22, the width W3 of the opposing side portions 23*a*1 and 23*a*2 of the second parallel section 23, and the width W4 of the connecting side portion 23*b* of the second parallel section 23. Thus, an increase of the outside dimension V1 in the V-direction can be restricted.

In the deformed folded dipole antenna 20 according to the present embodiment, the outside dimension V1 in the V-direction can be restricted, and the impedance can be larger than before controlling.

The first parallel section 22 and the second parallel section 23 are formed by patterning a conductive film on the front surface 31 and the rear surface 32 of the substrate 30 made of a dielectric material, and the short sections 24 are formed by filling the through holes 33 provided in the substrate 30 with a conductive material. Because the deformed folded dipole antenna 20 is formed by using a part of a multilayer substrate, a configuration of the deformed folded dipole antenna 20 can be simplified and a manufacturing cost can be reduced compared with a case where at least a part of the parallel sections 22 and 23 and the short sections 24 are made of a metal plate or a metal wire. Furthermore, the dimensions of the deformed folded dipole antenna 20 can be decreased by gaining a line length due to a wavelength shortening effect of the substrate 30 made of the dielectric material.

An impedance control method for obtaining the deformed folded dipole antenna 20 according to the present embodiment will be described below.

The width W1 of the opposing side portions 22*a*1 and 22*a*2 of the first parallel section 22 and the width W3 of the opposing side portions 23*a*1 and 23*a*2 of the second parallel section 23 are fixed, and a ratio W2/W4, that is a ratio of the width W2 of the connecting side portions 22*b*1 and 22*b*2 of the first parallel section 22 with respect to the width W4 of the connecting side portion 23*b* of the second parallel section 23 is changed.

The width W2 and the width W4 are controlled in a range where the ratio W2/W4 is larger than 1, that is, in a range where the width W2 is larger than the width W4 (W2>W4), so that the impedance of the deformed folded dipole antenna 20 is larger than before controlling and the impedance of the deformed folded dipole antenna 20 is substantially equal to the impedance (50Ω) of a coaxial cable. That is, the impedance matching with the coaxial cable is ensured.

In the impedance control method according to the present embodiment, as described in the knowledge (i), the impedance of the deformed folded dipole antenna 20 is increased by setting the width W2 of the connecting side portions 22*b*1 and 22*b*2 of the first parallel section 22 to be larger than the width W4 of the connecting side portion 23*b* of the second parallel section 23 (W2>W4) without changing the width W1 of the opposing side portions 22*a*1 and 22*a*2 of the first parallel section 22 and the width W3 of the opposing side portions 23*a*1 and 23*a*2 of the second parallel section 23. Thus, an increase of the outside dimension V1 in the V-direction can be effectively restricted.

In the above-described example, the width W4 is fixed. Alternatively, the width W4 may also be decreased so that the ratio W2/W4 is further increased and the impedance is further increased.

Figure 11A:
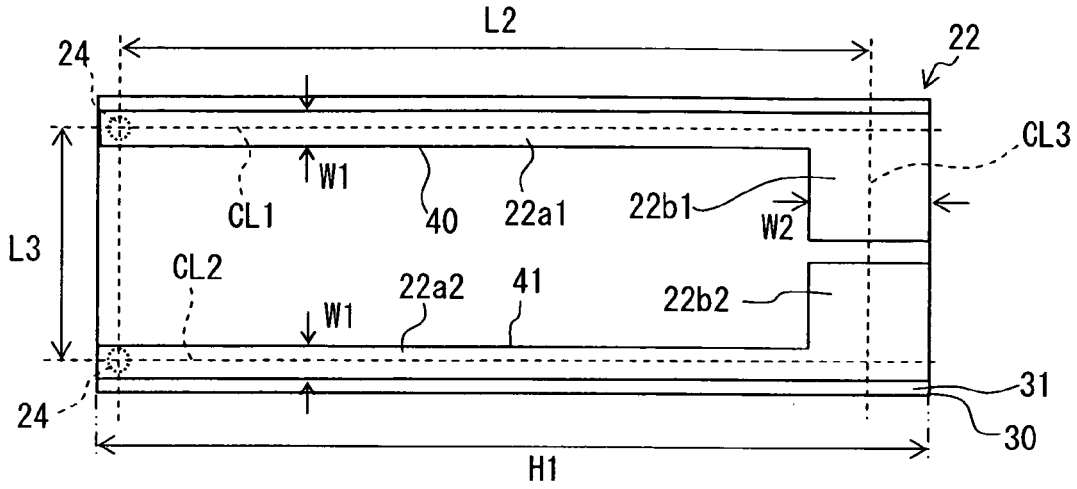
FIG. 11A is a plan view showing a first parallel section in a deformed folded dipole antenna according to a modification of the first embodiment.
Figure 11B:
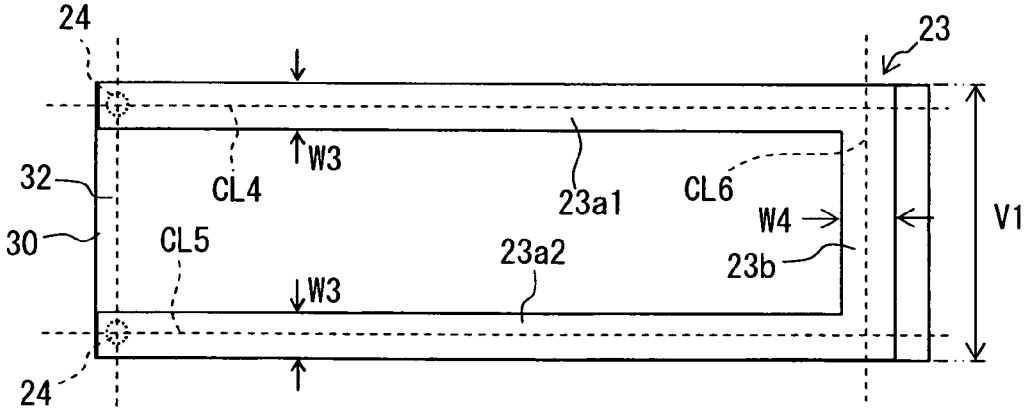
FIG. 11B is a plan view showing a second parallel section in the deformed folded dipole antenna according to the modification.

In the above-described example, the impedance is increased by controlling the widths W2 and W4 while fixing the widths W1 and W3. Alternatively, as described in the knowledge (iii), the impedance of the deformed folded dipole antenna 20 can be increased by setting the width W2 of the connecting side portions 22*b*1 and 22*b*2 of the first parallel section 22 to be larger than the widths W1, W3, and W4. Thus, the widths W1 and W3 may also be changed in such a manner that, the above-described relationship is satisfied. In a modification shown in FIG. 11A and FIG. 11B, the widths W2-W4 are same as the widths W2-W4 of the example shown in FIG. 10A and FIG. 10B, and the width W1 of the opposing side portions 22*a*1 and 22*a*2 of the first parallel section 22 is smaller than the width W3 of the opposing side portions 23*a*1 and 23*a*2 of the second parallel section 23. In the present case, because the ratio W1/W3 is smaller than that of the example shown in FIG. 10A and FIG. 10B, the impedance can be further increased.

Second Embodiment

Figure 12A:
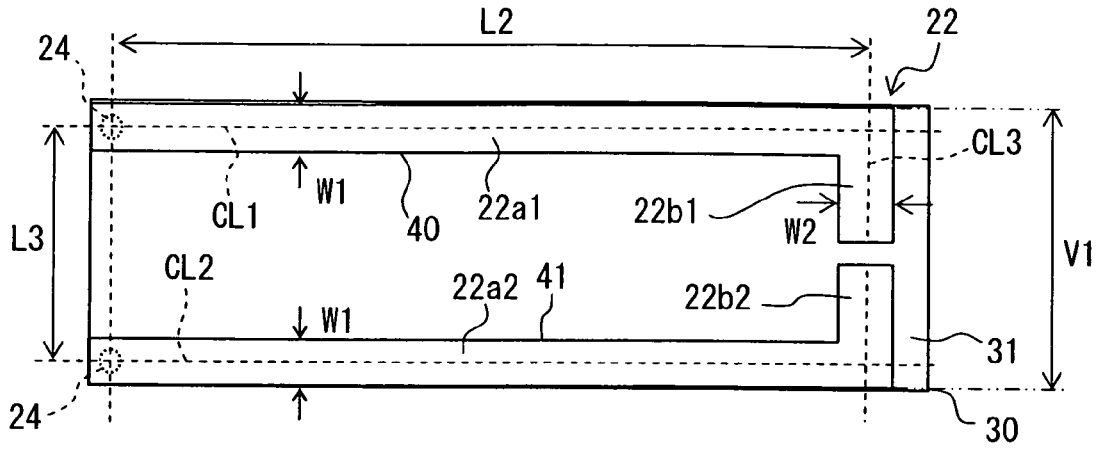
FIG. 12A is a plan view showing a first parallel section in a deformed folded dipole antenna according to a second embodiment of the present invention.
Figure 12B:
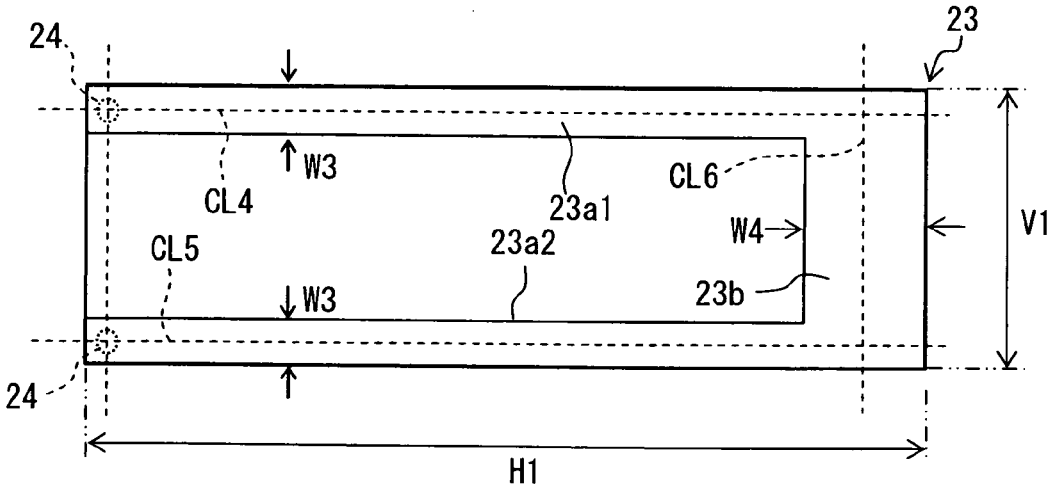
FIG. 12B is a plan view showing a second parallel section in the deformed folded dipole antenna according to the second embodiment.

A deformed folded dipole antenna 20 according to a second embodiment of the present invention will be described with reference to FIG. 12A and FIG. 12B. In the deformed folded dipole antenna 20 according to the present embodiment, the width W1 of the opposing side portions 22a1 and 22a2 of the first parallel section 22, the width W2 of the connecting side portions 22b1 and 22b2 of the first parallel section 22, and the width W3 of the opposing side portions 23a1 and 23a2 of the second parallel section 23 are equal to each other. The width W4 of the connecting side portion 23b of the second parallel section 23 is larger than the widths W1-W3.

Also in the deformed folded dipole antenna 20 according to the present embodiment, outside dimensions of the substrate 30 correspond to the outside dimensions V1 and H1 of the deformed folded dipole antenna 20 in the direction along the plane so that the outside dimensions of the deformed folded dipole antenna 20 including the substrate 30 can be small.

As described above, in the deformed folded dipole antenna 20 according to the present embodiment, the width W4 of the connecting side portion 23b of the second parallel section 23 is larger than the width W2 of the connecting side portions 22b1 and 22b2 of first parallel section (W4>W2). Thus, the impedance of the deformed folded dipole antenna 20 can be smaller than a case where the width W2 is equal to the width W4 (W2=W4) and when the width W4 is smaller than the width W2 (W4<W2).

In addition, the width W4 of the connecting side portion 23b of the second parallel section 23 is larger than the width W1 of the opposing side portions 22a1 and 22a2 of the first parallel section 22, the width W2 of the connecting side portions 22b1 and 22b2 of the first parallel section 22, and the width W3 of the opposing side portions 23a1 and 23a2 of the second parallel section 23. Thus, an increase of the outside dimension V1 in the V-direction can be restricted.

In the deformed folded dipole antenna 20 according to the present embodiment, the outside dimension V1 in the V-direction can be restricted, and the impedance can be smaller than before controlling.

The first parallel section 22 and the second parallel section 23 are formed by patterning a conductive film on the front surface 31 and the rear surface 32 of the substrate 30 made of a dielectric material, and the short sections 24 are formed by filling the through holes 33 provided in the substrate 30 with a conductive material. Thus, the configuration of the deformed folded dipole antenna 20 can be simplified and a manufacturing cost can be reduced. Furthermore, the dimensions of the deformed folded dipole antenna 20 can be decreased by gaining a line length due to a wavelength shortening effect of the substrate 30 made of the dielectric material.

An impedance control method for obtaining the deformed folded dipole antenna 20 according to the present embodiment will be described below.

Also in the deformed folded dipole antenna 20 according to the present embodiment, the width W1 of the opposing side portions 22a1 and 22a2 of the first parallel section 22 and the width W3 of the opposing side portions 23a1 and 23a2 of the second parallel section 23 are fixed, and a ratio W2/W4, that is a ratio of the width W2 of the connecting side portions 22b1 and 22b2 of the first parallel section 22 with respect to the width W4 of the connecting side portion 23b of the second parallel section 23 is changed.

The width W2 and the width W4 are controlled in a range where the ratio W2/W4 is smaller than 1, that is, in a range where the width W4 is larger than the width W2 (W4>W2), so that the impedance of the deformed folded dipole antenna 20 becomes a predetermined value smaller than before controlling.

In the impedance control method according to the present embodiment, as described in the knowledge (ii), the width W4 of the connecting side portion 23b of the second parallel section 23 is set to be larger than the width W2 of the connecting side portions 22b1 and 22b2 of the first parallel section 22 (W4>W2) without changing the width W1 of the opposing side portions 22a1 and 22a2 of the first parallel section 22 and the width W3 of the opposing side portions 23a1 and 23a2 of the second parallel section 23 so that the impedance of the deformed folded dipole antenna 20 is decreased compared with a case were the width W4 is equal to the width W2 (W4=W2) and a case where the width W4 is smaller than the width W2 (W4<W2). Thus, an increase of the outside dimension V1 in the V-direction can be effectively restricted.

In the above-described example, the width W2 is fixed. Alternatively, the width W2 may also be decreased so that the ratio W2/W4 is further decreased and the impedance is further decreased.

In the above-described example, the impedance is decreased by controlling the widths W2 and W4 while fixing the widths W1 and W3. Alternatively, as described in the knowledge (iv), the impedance of the deformed folded dipole antenna 20 can be decreased by setting the width W4 of the connecting side portion 23b of the second parallel section 23 to be larger than the widths W1-W3. Thus, the widths W1 and W3 may also be changed in such a manner that the above-described relationship is satisfied. The impedance can be further decreased by changing at least one of the widths W1 and W3 in such a manner that the ratio W1/W3 is increased.

Third Embodiment

An antenna device 100 according to a third embodiment of the present invention will be described with reference to FIG. 13 and FIG. 14.

Figure 13:
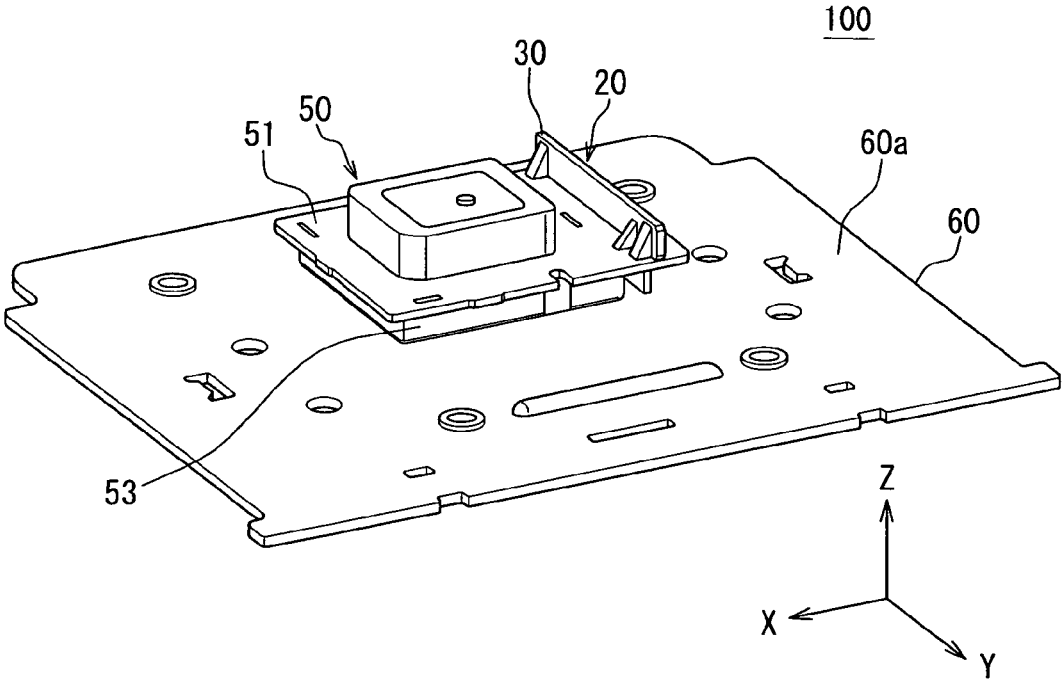
FIG. 13 is a perspective view showing an antenna device according to a third embodiment of the present invention.

In FIG. 13, a Z-direction indicates a vertical direction, and an X-direction and a Y-direction indicate directions perpendicular to the vertical direction.

The antenna device 100 includes a housing in which a deformed folded dipole antenna 20 and a global positioning system antenna (GPS antenna) 50 are disposed. The deformed folded dipole antenna 20 may be one of the deformed folded dipole antennas 20 described above. The deformed folded dipole antenna 20 is configurated to receive road traffic information. The GPS antenna 50 is configured as a so-called patch antenna. The GPS antenna 50 includes a dielectric body having a rectangular parallel piped shape. On a first surface of the dielectric body, a radiating element 50a is disposed. On a second surface of the dielectric body opposed to the first surface, a ground (not shown) is formed.

The housing includes a case having an opening at one side and a cover 60 that covers the opening. In the example shown in FIG. 13, the cover 60 is a metal plate that functions as a ground plane. A ground plane may also be provided aside from the cover 60.

The deformed folded dipole antenna 20 and the GPS antenna 50 are disposed on a substrate 51. The substrate 51 can function as a common substrate. The substrate 51 has a first surface 51a and a second surface 51b opposed to the first surface 51a. The GPS antenna 50 is mounted on the substrate 51 in such a manner that the second surface of the dielectric body opposes the first surface 51a of the substrate 51. The substrate 51 has a through hole extending from the first surface 51a to the second surface 51b. The substrate 30 of the deformed folded dipole antenna 20 is inserted into the through hole. The substrate 30 is supported by a supporting member 52.

On the substrate 51, a matching circuit and a wireless circuit are formed. The deformed folded dipole antenna 20 and the GPS antenna 50 are electrically coupled with the matching circuit and the wireless circuit. The circuits formed on the substrate 51 are coupled with a connector (not shown) through a coaxial cable (not shown). The connector is coupled, for example, with a navigation device. On the second surface 51*b* of the substrate 51, an electromagnetic wave shielding member 53 is disposed.

The substrate 51 is disposed on a surface 60*a* of the cover 60 through the electromagnetic wave shielding member 53. In this way, the deformed folded dipole antenna 20 and the GPS antenna 50 are disposed above the cover 60.

Each of the deformed folded dipole antenna 20 and the GPS antenna 50 receives radio wave from infrastructures including a satellite and a device on a road. Arrival directions of the radio wave are directions within a hemisphere face provided on the upper side of each of the deformed folded dipole antenna 20 and the GPS antenna 50 in the vertical direction. Thus, it is preferred that each of the deformed folded dipole antenna 20 and the GPS antenna 50 is disposed in such a manner that the directivity in the hemisphere face is non-directional for a polarized wave. In the GPS antenna 50, the polarized wave is a right-handed circularly polarized wave. In the deformed folded dipole antenna 20, the polarized wave is a vertically polarized wave. In the antenna device 100 according to the present embodiment, the first surface 51*a* and the second surface 51*b* of the substrate 51 are arranged in parallel with the surface 60*a* of the cover 60, which can function as the ground plane, and the first surface of the GPS antenna 50 on which the radiating element 50*a* is formed is arranged in parallel with the surface 60*a* of the cover 60. The substrate 30 of the deformed folded dipole antenna 20 is inserted in the through hole of the substrate 51 in such a manner that the connecting side portions 22*b*1, 22*b*2, and 23*b* are parallel with a thickness direction of the substrate 51 and the opposing side portions 22*a*1, 22*a*2, 23*a*1, and 23*a*2 are perpendicular to the thickness direction of the substrate 51. Thus, the connecting side portions 22*b*1, 22*b*2, and 23*b* are perpendicular to the surface 60*a* of the cover 60, and the opposing side portions 22*a*1, 22*a*2, 23*a*1, and 23*a*2 are parallel with the surface 60*a* of the cover 60. Thus, when the antenna device 100 is mounted on a vehicle in such a manner that the surface 60*a* of the cover is perpendicular to the vertical direction of the vehicle, the first surface of the GPS antenna 50 on which the radiating element 50*a* is formed is perpendicular to the vertical direction. In addition, the connecting side portions 22*b*1, 22*b*2, and 23*b* of the deformed folded dipole antenna 20 are parallel with the vertical direction, and the opposing side portions 22*a*1, 22*a*2, 23*a*1, and 23*a*2 are perpendicular to the vertical direction.

In the antenna device 100, the connecting side portions 22*b*1, 22*b*2, and 23*b* close to the feeding points and having high current density are arranged in parallel with the vertical direction. Thus, an antenna gain (vertically polarized wave gain) can be improved compared with a case where the connecting side portions 22*b*1, 22*b*2, and 23*b* are perpendicular to the vertical direction. Furthermore, the directivity in the hemisphere face provided on the upper side of the deformed folded dipole antenna 20 can be non-directional for a vertically polarized wave.

Because the deformed folded dipole antenna 20 and the GPS antenna 50 are disposed on the common substrate 51, a configuration of the antenna device 100 can be simplified. In addition, in each of the deformed folded dipole antenna 20 and the GPS antenna 50, the directivity in the hemisphere face can be non-directional for the polarized wave of each antenna.

Figure 16A:
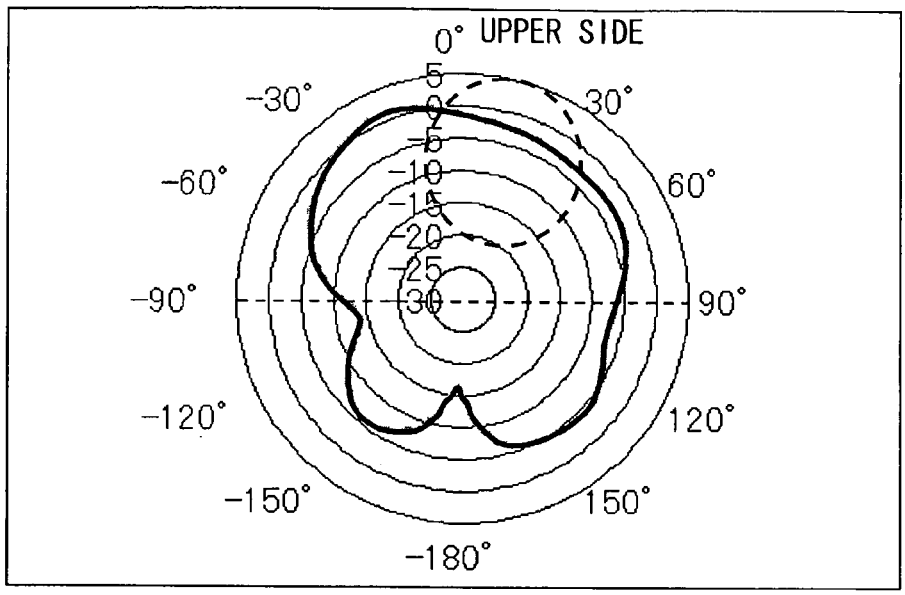
FIG. 16A is a diagram showing a directivity for a vertically polarized wave in the deformed folded dipole antenna according to the third embodiment.
Figure 16B:
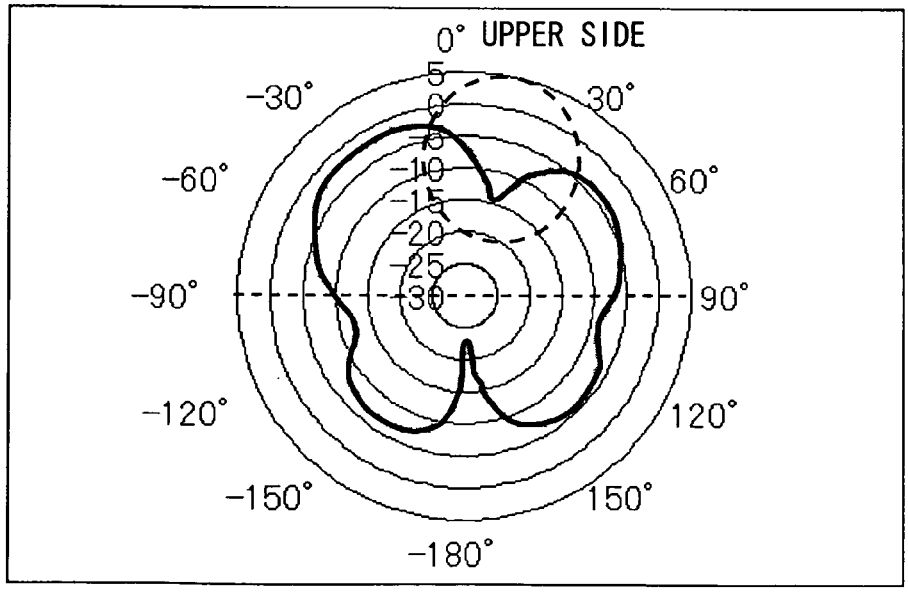
FIG. 16B is a diagram showing a directivity for a vertically polarized wave in a deformed folded dipole antenna according to a comparative example.

In the opposing side portions 22*a*1, 22*a*2, 23*a*1, and 23*a*2, the opposing side portions 22*a*1 and 23*a*1 are called first opposing side portions, and the opposing side portions 22*a*2 and 23*a*2 are called second opposing side portions. The inventors found that, in a case where a length of the first opposing side portions 22*a*1 and 23*a*1 is equal to a length of the second opposing side portions 22*a*2 and 23*a*2, and a metal member is closer to the second opposing side portions 22*a*2 and 23*a*2 than the first opposing side portions 22*a*1 and 23*a*1, a distortion is generated in the directivity for a vertically polarized wave in the hemisphere face provided on the upper side of the deformed folded dipole antenna 20, that is, in a vertical directivity. An example of the distortion is shown in FIG. 16B. In the example shown in FIG. 16B, the distortion is generated in a portion shown by a dashed circle. In FIG. 16A and FIG. 16B, 0 degree indicates the upper side in the vertical direction. In the example shown in FIG. 13 and FIG. 14, the electromagnetic wave shielding member 53 and the cover 60 are closer to the second opposing side portions 22*a*2 and 23*a*2 than the first opposing side portions 22*a*1 and 23*a*1. The electromagnetic wave shielding member 53 and the cover 60 correspond to the metal member.

Figure 15A:
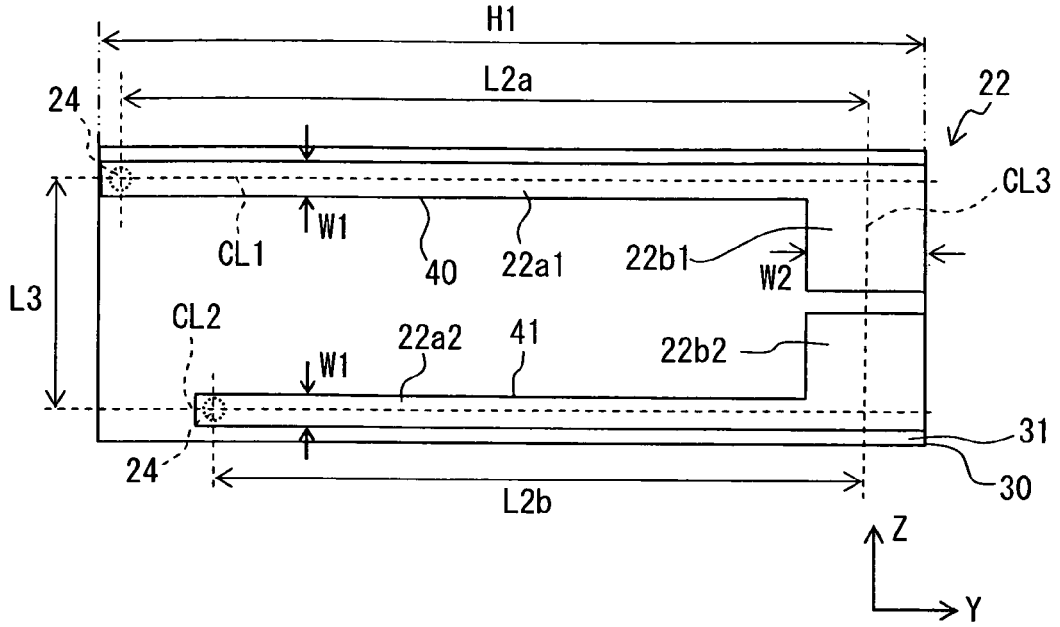
FIG. 15A is a plan view showing a first parallel section in a deformed folded dipole antenna according to the third embodiment.
Figure 15B:
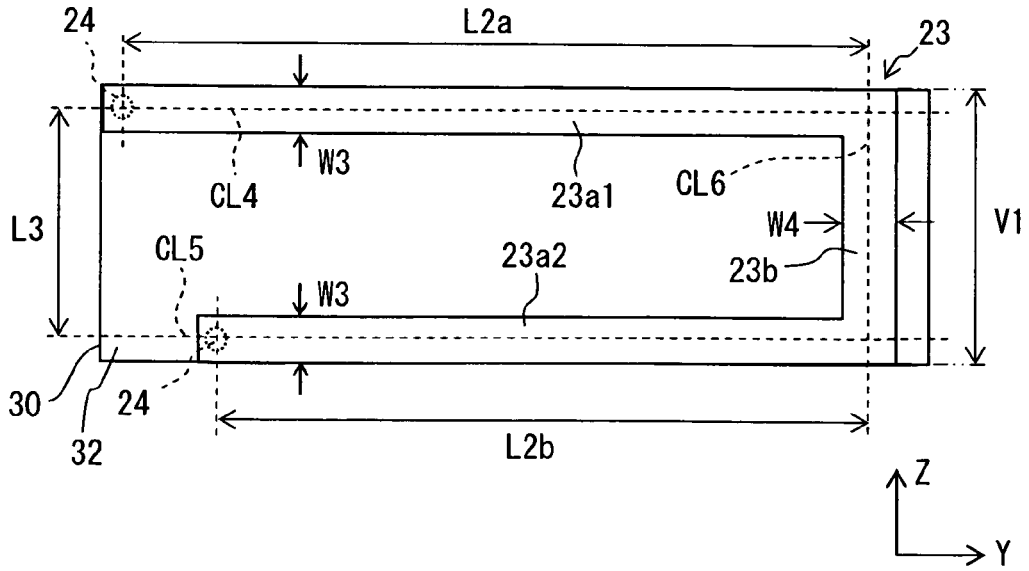
FIG. 15B is a plan view showing a second parallel section in the deformed folded dipole antenna according to the third embodiment.

The inventors studied in order to improve the distortion, that is, to improve the non-directivity. When electric current flows in the second opposing side portions 22*a*2 and 23*a*2 close to the metal member (for example, the cover 60 as the ground plane), image current is induced in the metal member. The inventors thought that the distortion is caused by the image current and set the electric length of the second opposing side portions 22*a*2 and 23*a*2 including the image current to be equal to the electric length of the first opposing side portions 22*a*1 and 23*a*1. In other words, as shown in FIG. 15A and FIG. 15B, the length L2*b* of the second opposing side portions 22*a*2 and 23*a*2 is set to be shorter than the length L2*a* of the first opposing side portions 22*a*1 and 23*a*1. The deformed folded dipole antenna 20 shown in FIG. 15A and FIG. 15B is similar to the deformed folded dipole antenna shown in FIG. 11A and FIG. 11B except that the lengths L2*a* and L2*b* are different from each other.

The directivity for a vertically polarized wave in the deformed folded dipole antenna 20 shown in FIG. 15A and FIG. 15B is shown in FIG. 16A. As shown in FIG. 16A, especially in the dashed circle, the directivity for a vertically polarized wave in the hemisphere face provided on the upper side in the vertical direction can be improved.

In the antenna device 100 according to the present embodiment, in view of the image current, the length L2*b* of the second opposing side portions 22*a*2 and 23*a*2 is set to shorter than the length L2*a* of the first opposing side portions 22*a*1 and 23*a*1. Thus, the non-directivity for a vertically polarized wave in the hemisphere face provided on the upper side in the vertical direction can be improved compared with a case where the length L2*b* of the second opposing side portions 22*a*2 and 23*a*2 is equal to the length L2*a* of the first opposing side portions 22*a*1 and 23*a*1.

Figure 14:
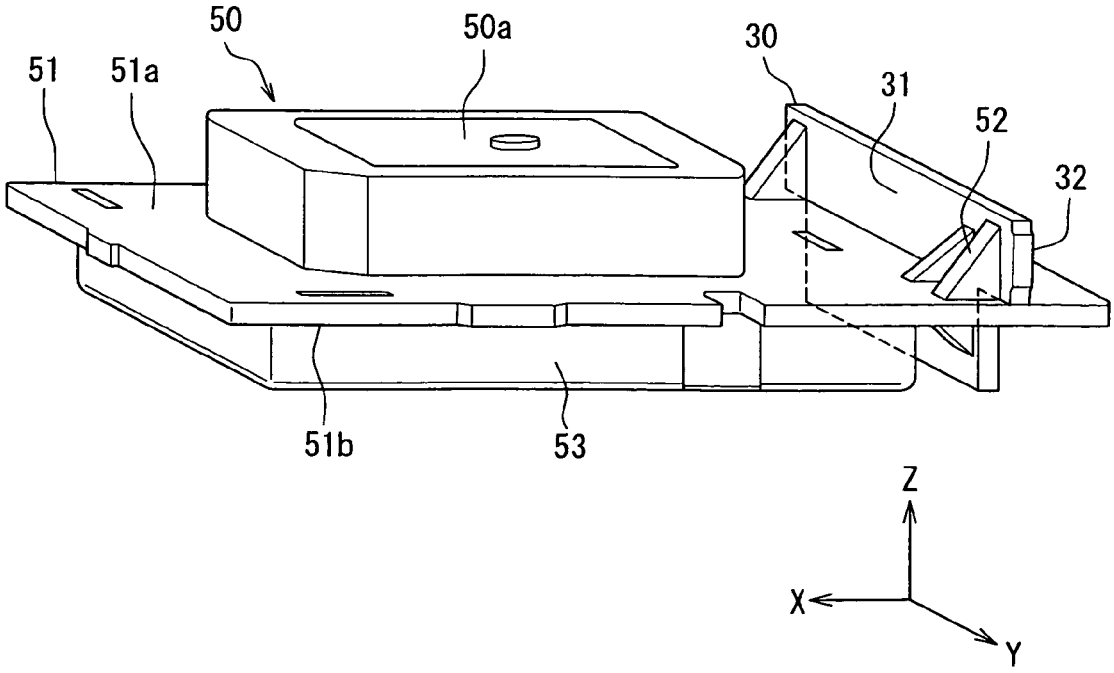
FIG. 14 is a perspective view showing a part of the antenna device including a deformed folded dipole antenna and a GPS antenna.

In the example shown in FIG. 13 and FIG. 14, the cover 60 as the ground plane and the electromagnetic wave shielding member 53 are provided as the metal member in which image current is induced. Alternatively, the antenna device 100 may also include at least one of the cover 60 (ground plane) and the electromagnetic wave shielding member 53.

The antenna device 100 may also include only the deformed folded dipole antenna 20 as an antenna, and the connecting side portions 22*b*1, 22*b*2, and 23*b* close to the feeding points and having the high current density may be arranged in parallel with the vertical direction. Accordingly, an antenna gain of the deformed folded dipole antenna 20 can be improved. In addition, the directivity for a vertically polarized wave in the hemisphere face provided on the upper side in the vertical direction can be non-directional.

In the example shown in FIG. 13 and FIG. 14, the antenna device 100 includes the deformed folded dipole antenna 20 and the GPS antenna 50 as antennas. The antenna device 100 may also include an antenna (for example, an antenna for a short range communication) instead of the GPS antenna 50, in addition to the deformed folded dipole antenna 20. The antenna device 100 may also include an antenna other than the deformed folded dipole antenna 20 and the GPS antenna 50 in addition to the deformed folded dipole antenna 20 and the GPS antenna 50.

In the example shown in FIG. 13 and FIG. 14, the GPS antenna 50 and the deformed folded dipole antenna 20 are disposed on the common substrate 51. The GPS antenna 50 and the deformed folded dipole antenna 20 may also be disposed on different substrates. Alternatively, the GPS antenna 50 may also be formed in the substrate 51 and the deformed folded dipole antenna 20 may also be disposed on the substrate 51.

In the above-described example, the deformed folded dipole antenna 20 is configured to receive road traffic information. The deformed folded dipole antenna 20 may also be used as a vertically-polarized wave antenna for other application including, for example, a telephone antenna for mobile communication.

In the example shown in FIG. 13 and FIG. 14, the first opposing side portions far from the metal member are opposing side portions 22*a*1 and 23*a*1, and the second opposing side portions close to the metal member are opposing side portions 22*a*2 and 23*a*2. Alternatively, the opposing side portions 22*a*1 and 23*a*1 may also be the second opposing side portions close to the metal member, and the opposing side portions 22*a*2 and 23*a*2 may be the first opposing side portions.

In the above-described example, the width W4 is fixed. The impedance can be further increased by setting the width W4 to be smaller than before controlling and thereby increasing the ratio W2/W4.

In the example shown in FIG. 15A and FIG. 15B, the width W1 is different from the width W3. Alternatively, as shown in FIG. 10A and FIG. 10B, the impedance may also be increased by changing only the widths W2 and W4 while fixing the widths W1 and W3. Furthermore, the configuration described in the second embodiment may also be applied to the antenna device 100.

Other Embodiments

Although the present invention has been fully described in connection with the preferred embodiments thereof with reference to the accompanying drawings, it is to be noted that various changes and modifications will become apparent to those skilled in the art.

Applications of the deformed folded dipole antenna 20 is not limited to an antenna for receiving road traffic information, and the deformed folded dipole antenna 20 may also be used as an antenna for other device including a wireless device and a portable device.

In the above-described embodiments, the first parallel section 22 and the second parallel section 23 are formed by patterning the conductive layers disposed on the front surface 31 and the rear surface 32 of the substrate 30, and the short sections 24 are interlayer connectors formed by filling the through holes 33 penetrating the substrate 30 with the conductive member. The configuration using the substrate 30 is not limited to the above-described example.

For example, the deformed folded dipole antenna 20 may include the substrate 30 made of an insulating material and including a plurality of conductive patterns arranged in a thickness direction, each of the first parallel section 22 and the second parallel section 23 may be provided by one of the conductive patterns, and the short section 24 may be provided by interlayer connectors formed by filling holes in the substrate 30 with a conductive material. At least one of the first parallel section 22 and the second parallel section 23 may also be provided by an internal layer pattern in the substrate 30. When the internal layer pattern is used, the interlayer connectors as the short section 24 are connecting via holes formed by filling via holes in the substrate 30 with a conductive material.

Alternatively, the substrate 30 may not include the interlayer connectors, and the first parallel section 22 and the second parallel section 23 located in different layers may be electrically coupled with a conductive member through a side surface of the substrate 30.

The deformed folded dipole antenna 20 may also be formed by using a metal plate and a metal wire instead of the substrate 30.

In the above-described embodiments, in the first parallel section 22 and the second parallel section 23, the electric length L2 in the H-direction is longer than the electric length L3 in the V-direction. Alternatively, the electric length L2 in the H-direction may also be shorter than the electric length L3 in the V-direction. Also in this case, the configuration and the impedance control methods described above can be applied.

As described above, the impedance of the folded dipole antenna is about 293Ω. In the example shown in FIG. 3A to FIG. 4B in which the electric length L2 in the H-direction is longer than the electric length L3 in the V-direction, the impedance is 17Ω. Thus, in a case where the electric length L2 in the H-direction is shorter than the electric length L3 in the V-direction, it can be considered that the impedance is higher than the impedance of the coaxial cable (50 Ω or 70Ω), and the impedance is decreased for ensuring an impedance matching with the coaxial cable. In this case, the configuration and the impedance control method described in the second embodiment can be applied.

A dielectric member may be disposed at a region between the pair of opposing side portions 22*a*1 and 22*a*2 or 23*a*1 and 23*a*2. In this case, the dimensions of the deformed folded dipole antenna 20 can be decreased by gaining a line length due to a wavelength shortening effect.

In the above-described embodiments, the widths W1 and W3 are controlled while fixing the distance between the center lines CL1 and CL2 and the distance between the center lines CL4 and CL5. In other words, for example, in the opposing side portion 22*a*1, the width W1 is controlled in such a manner the widths on both sides of the center line CL1 are equal to each other. Alternatively, for example, in the opposing side portion 22*a*1, the width W1 may also be controlled in such a manner that the widths are different on both sides of the center line CL1.

The current density of the deformed folded dipole antenna 20 increases toward the feeding points and decreases towards the ends of the U-shape coupled with the short sections 24. Thus, the widths of the parallel sections 21 may be changed from the feeding points toward the ends. For example, the width may be decreased from a portion close to the feeding points where the current density is high to the ends of the U-shape. Accordingly, an arrangement area of the deformed folded dipole antenna 20 can be decreased. For example, in the substrate 30, a forming area of the deformed folded dipole antenna 20 can be decreased, and a mounting area of other parts can be ensured.

What is claimed is:

1. A method of controlling an impedance of a deformed folded dipole antenna, the deformed folded dipole antenna including a first parallel section and a second parallel section made of a conductive material, the first parallel section arranged along a first plane and the second parallel section arranged along a second plane parallel with the first plane, a width of the first parallel section is within the first plane and is greater than a thickness of the first parallel section which is within a plane perpendicular to the first plane, and a width of the second parallel section is within the second plane and is greater than a thickness of the second parallel section which is within a plane perpendicular to the second plane, and two short sections made of conductive material, each of the short sections being shorter than the first parallel section and the second parallel section, each of the short sections coupling an end of the first parallel section with a corresponding end of the second parallel section, wherein:

the second parallel section has a U-shape including a first opposing side portion, a second opposing side portion, and a connecting side portion;

the first opposing side portion and the second opposing side portion are opposed to each other and the connecting side portion couples an end of the first opposing side portion with an end of the second opposing side portion;

the first parallel section has a cut U-shape including a first L-shape section and a second L-shape section;

the first L-shape section includes a portion arranged in parallel with the first opposing side portion and a portion arranged in parallel with a part of the connecting side portion;

the second L-shape section includes a portion arranged in parallel with the second opposing side portion and a portion arranged in parallel with another part of the connecting side portion;

the first L-shape section has a feeding point at an end of the portion arranged in parallel with the connecting side portion;

the second L-shape section has a feeding point at an end of the portion arranged in parallel with the connecting side portion;

the portion of the first L-shape section arranged in parallel with the connecting side portion is arranged in a same straight line with the portion of the second L-shape section arranged in parallel with the connecting side portion;

the end of the first L-shape section is opposed to the end of the second L-shape section at a distance;

the portion of the first L-shape section arranged in parallel with the first opposing side portion and the portion of the second L-shape section arranged in parallel with the second opposing side portion have a width W1 in a first direction along the first plane;

the portion of the first L-shape section arranged in parallel with the connecting side portion and the portion of the second L-shape section arranged in parallel with the connecting side portion have a width W2 in a second direction along the first plane;

the first opposing side portion and the second opposing side portion have a width W3 in the first direction along the second plane;

the connecting side portion has a width W4 in the second direction along the second plane, the method of controlling the impedance comprising setting the width W2 to be larger than the widths W1, W3, and W4, wherein when the width W2 is greater than the width W4, the impedance is higher than when the width W2 is less than or equal to the width W4.

2. A method of controlling an impedance of a deformed folded dipole antenna, the deformed folded dipole antenna including a first parallel section and a second parallel section made of a conductive material, the first parallel section arranged along a first plane and the second parallel section arranged along a second plane parallel with the first plane, a width of the first parallel section is within the first plane and is greater than a thickness of the first parallel section which is within a plane perpendicular to the first plane, and a width of the second parallel section is within the second plane and is greater than a thickness of the second parallel section which is within a plane perpendicular to the second plane, and two short sections made of a conductive material, each of the short sections being shorter than the first parallel section and the second parallel section, each of the short sections coupling an end of the first parallel section with a corresponding end of the second parallel section, wherein:

the second parallel section has a U-shape including a first opposing side portion, a second opposing side portion, and a connecting side portion;

the first opposing side portion and the second opposing side portion are opposed to each other and the connecting side portion couples an end of the first opposing side portion with an end of the second opposing side portion;

the first parallel section has a cut U-shape including a first L-shape section and a second L-shape section;

the first L-shape section includes a portion arranged in parallel with the first opposing side portion and a portion arranged in parallel with a part of the connecting side portion;

the second L-shape section includes a portion arranged in parallel with the second opposing side portion and a portion arranged in parallel with another part of the connecting side portion;

the first L-shape section has a feeding point at an end of the portion arranged in parallel with the connecting side portion;

the second L-shape section has a feeding point at an end of the portion arranged in parallel with the connecting side portion;

the portion of the first L-shape section arranged in parallel with the connecting side portion is arranged in a same straight line with the portion of the second L-shape section arranged in parallel with the connecting side portion;

the end of the first L-shape section is opposed to the end of the second L-shape section at a distance;

the portion of the first L-shape section arranged in parallel with the first opposing side portion and the portion of the second L-shape section arranged in parallel with the second opposing side portion with a width W1 in a first direction along the first plane;

the portion of the first L-shape section arranged in parallel with the connecting side portion and the portion of the second L-shape section arranged in parallel with the connecting side portion have a width W2 in a second direction along the first plane;

the first opposing side portion and the second opposing side portion have a width W3 in the first direction along the second plane; and the connecting side portion has a width W4 in the second direction along the second plane, the method of controlling the impedance comprising setting the width W4 to be larger than the widths W1-W3, wherein when the width W4 is greater than the width W2, the impedance is lower than when the width W4 is less than or equal to the width W2.

3. A method of controlling an impedance of a deformed folded dipole antenna, the deformed folded dipole antenna including a first parallel section and a second parallel section made of a conductive material, the first parallel section arranged along a first plane and the second parallel section arranged along a second plane parallel with the first plane, a width of the first parallel section is within the first plane and is greater than a thickness of the first parallel section which is within a plane perpendicular to the first plane, and a width of the second parallel section is within the second plane and is greater than a thickness of the second parallel section which is within a plane perpendicular to the second plane, and two short sections made of a conductive material, each of the short sections being shorter than the first parallel section and the second parallel section, each of the short sections coupling an end of the first parallel section with a corresponding end of the second parallel section, wherein:

the second parallel section has a U-shape including a first opposing side portion, a second opposing side portion, and a connecting side portion;

the first opposing side portion and the second opposing side portion are opposed to each other and the connecting side portion couples an end of the first opposing side portion with an end of the second opposing side portion;

the first parallel section has a cut U-shape including a first L-shape section and a second L-shape section;

the first L-shape section includes a portion arranged in parallel with the first opposing side portion and a portion arranged in parallel with a part of the connecting side portion;

the second L-shape section includes a portion arranged in parallel with the second opposing side portion and a portion arranged in parallel with another part of the connecting side portion;

the first L-shape section has a feeding point at an end of the portion arranged in parallel with the connecting side portion;

the second L-shape section has a feeding point at an end of the portion arranged in parallel with the connecting side portion;

the portion of the first L-shape section arranged in parallel with the connecting side portion is arranged in a same straight line with the portion of the second L-shape section arranged in parallel with the connecting side portion;

the end of the first L-shape section is opposed to the end of the second L-shape section at a distance;

the portion of the first L-shape section arranged in parallel with the first opposing side portion and the portion of the second L-shape section arranged in parallel with the second opposing side portion have a width W1 in a first direction along the first plane;

the portion of the first L-shape section arranged in parallel with the connecting side portion and the portion of the second L-shape section arranged in parallel with the connecting side portion have a width W2 in a second direction along the first plane;

the first opposing side portion and the second opposing side portion have a width W3 in the first direction along the second plane; and the connecting side portion has a width W4 in the second direction along the second plane, the method of controlling the impedance comprising controlling a ratio of the width W2 with respect to the width W4 in a state where the width W1 and the width W3 are fixed, wherein when the ratio of the width W2 with respect to the width W4 is greater than one, the impedance is higher than when the ratio of the width W2 with respect to the width W4 is less than or equal to one.

4. A deformed folded dipole antenna comprising a first parallel section and a second parallel section made of a conductive material, the first parallel section arranged along a first plane and the second parallel section arranged along a second plane parallel with the first plane, a width of the first parallel section is within the first plane and is greater than a thickness of the first parallel section which is within a plane perpendicular to the first plane, and a width of the second parallel section is within the second plane and is greater than a thickness of the second parallel section which is within a plane perpendicular to the second plane, and two short sections made of a conductive material, each of the short sections being shorter than the first parallel section and the second parallel section, each of the short sections coupling an end of the first parallel section with a corresponding end of the second parallel section, wherein:

the second parallel section has a U-shape including a first opposing side portion, a second opposing side portion, and a connecting side portion;

the first opposing side portion and the second opposing side portion are opposed to each other and the connecting side portion couples an end of the first opposing side portion with an end of the second opposing side portion;

the first parallel section has a cut U-shape including a first L-shape section and a second L-shape section;

the first L-shape section includes a portion arranged in parallel with the first opposing side portion and a portion arranged in parallel with a part of the connecting side portion;

the second L-shape section includes a portion arranged in parallel with the second opposing side portion and a portion arranged in parallel with another part of the connecting side portion;

the first L-shape section has a feeding point at an end of the portion arranged in parallel with the connecting side portion;

the second L-shape section has a feeding point at an end of the portion arranged in parallel with the connecting side portion;

the portion of the first L-shape section arranged in parallel with the connecting side portion is arranged in a same straight line with the portion of the second L-shape section arranged in parallel with the connecting side portion;

the end of the first L-shape section is opposed to the end of the second L-shape section at a distance;

the portion of the first L-shape section arranged in parallel with the first opposing side portion and the portion of the second L-shape section arranged in parallel with the second opposing side portion have a width W1 in a first direction along the first plane;

the portion of the first L-shape section arranged in parallel with the connecting side portion and the portion of the second L-shape section arranged in parallel with the connecting side portion have a width W2 in a second direction along the first plane;

the first opposing side portion and the second opposing side portion have a width W3 in the first direction along the second plane;

the connecting side portion has a width W4 in the second direction along the second plane; and the width W2 is larger than the widths W1, W3, and W4, such that the impedance is higher than when the width W2 is less than or equal to the width W4.

5. The deformed folded dipole antenna according to claim 4, comprising a substrate made of a dielectric material, the substrate including a plurality of conductive patterns arranged in a thickness direction of the substrate and a plurality of interlayer connectors formed by filling a plurality of holes provided in the substrate with the conductive material, wherein each of the first parallel section and the second parallel section is provided by one of the plurality of conductive patterns, and each of the short sections is provided by one of the plurality of interlayer connectors.

6. An antenna device including the deformed folded dipole antenna according to claim 4, wherein the connecting side portion is arranged in parallel with a vertical direction, and the first opposing side portion and the second opposing side portion are perpendicular to the vertical direction.

7. The antenna device according to claim 6, further comprising a global positioning system antenna including a radiating element, and a common substrate on which the deformed folded dipole antenna and the global positioning system antenna are disposed, wherein:

the deformed folded dipole antenna is configured to receive road traffic information;

the global positioning system antenna has a surface on which the radiating element is formed; and the surface of the global positioning system antenna is perpendicular to the vertical direction.

8. The antenna device according to claim 6, further comprising a metal member having a surface perpendicular to the vertical direction, the metal member being closer to the second opposing side portion than the first opposing side portion in the vertical direction, wherein:

the first opposing side portion and the portion of the first L-shape section arranged in parallel with the first opposing side portion have a length L2*a;* the second opposing side portion and the portion of the second L-shape section arranged in parallel with the second opposing side portion have a length L2*b*; and the length L2*b* is shorter than the length L2*a*.

9. The antenna device according to claim 8, wherein the metal member includes a ground plane.

10. The antenna device according to claim 8, wherein the metal member includes an electromagnetic wave shielding member.

11. A deformed folded dipole antenna comprising a first parallel section and a second parallel section made of a conductive material, the first parallel section arranged along a first plane and the second parallel section arranged along a second plane parallel with the first plane, a width of the first parallel section is within the first plane and is greater than a thickness of the first parallel section which is within a plane perpendicular to the first plane, and a width of the second parallel section is within the second plane and is greater than a thickness of the second parallel section which is within a plane perpendicular to the second plane, and two short sections made of a conductive material, each of the short sections being shorter than the first parallel section and the second parallel section, each of the short sections coupling an end of the first parallel section with a corresponding end of the second parallel section, wherein:

the second parallel section has a U-shape including a first opposing side portion, a second opposing side portion, and a connecting side portion;

the first opposing side portion and the second opposing side portion are opposed to each other and the connecting side portion couples an end of the first opposing side portion with an end of the second opposing side portion;

the first parallel section has a cut U-shape including a first L-shape section and a second L-shape section;

the first L-shape section includes a portion arranged in parallel with the first opposing side portion and a portion arranged in parallel with a part of the connecting side portion;

the second L-shape section includes a portion arranged in parallel with the second opposing side portion and a portion arranged in parallel with another part of the connecting side portion;

the first L-shape section has a feeding point at an end of the portion arranged in parallel with the connecting side portion;

the second L-shape section has a feeding point at an end of the portion arranged in parallel with the connecting side portion;

the portion of the first L-shape section arranged in parallel with the connecting side portion is arranged in a same straight line with the portion of the second L-shape section arranged in parallel with the connecting side portion;

the end of the first L-shape section is opposed to the end of the second L-shape section at a distance;

the portion of the first L-shape section arranged in parallel with the first opposing side portion and the portion of the second L-shape section arranged in parallel with the second opposing side portion have a width W1 in a first direction along the first plane;

the portion of the first L-shape section arranged in parallel with the connecting side portion and the portion of the second L-shape section arranged in parallel with the connecting side portion have a width W2 in a second direction along the first plane;

the first opposing side portion and the second opposing side portion have a width W3 in the first direction along the second plane;

the connecting side portion has a width W4 in the second direction along the second plane; and the width W4 is larger than the widths W1-W3, such that the impedance is lower than when the width W4 is less than or equal to the width W2.

12. The deformed folded dipole antenna according to claim 11, comprising a substrate made of a dielectric material, the substrate including a plurality of conductive patterns arranged in a thickness direction of the substrate and a plurality of interlayer connectors formed by filling a plurality of holes provided in the substrate with the conductive material, wherein each of the first parallel section and the second parallel section is provided by one of the plurality of conductive patterns, and each of the short sections is provided by one of the plurality of interlayer connectors.

13. An antenna device including the deformed folded dipole antenna according to claim 11, wherein the connecting side portion is arranged in parallel with a vertical direction, and the first opposing side portion and the second opposing side portion are perpendicular to the vertical direction.

14. The antenna device according to claim 13, further comprising a global positioning system antenna including a radiating element, and a common substrate on which the deformed folded dipole antenna and the global positioning system antenna are disposed, wherein:

the deformed folded dipole antenna is configured to receive road traffic information;

the global positioning system antenna has a surface on which the radiating element is formed; and the surface of the global positioning system antenna is perpendicular to the vertical direction.

15. The antenna device according to claim 13, further comprising a metal member having a surface perpendicular to the vertical direction, the metal member being closer to the second opposing side portion than the first opposing side portion in the vertical direction, wherein:

the first opposing side portion and the portion of the first L-shape section arranged in parallel with the first opposing side portion have a length L2*a;* the second opposing side portion and the portion of the second L-shape section arranged in parallel with the second opposing side portion have a length L2*b*; and the length L2*b* is shorter than the length L2*a*.

16. The antenna device according to claim 15, wherein the metal member includes a ground plane.

17. The antenna device according to claim 15, wherein the metal member includes an electromagnetic wave shielding member.

* * * * *